US005745651A

United States Patent [19]

Otsuka et al.

[11] Patent Number: 5,745,651

[45] Date of Patent: Apr. 28, 1998

[54] SPEECH SYNTHESIS APPARATUS AND METHOD FOR CAUSING A COMPUTER TO PERFORM SPEECH SYNTHESIS BY CALCULATING PRODUCT OF PARAMETERS FOR A SPEECH WAVEFORM AND A READ WAVEFORM GENERATION MATRIX

[75] Inventors: Mitsuru Otsuka; Yasunori Ohora; Takashi Aso; Toshiaki Fukada, all of Yokohama, Japan

[73] Assignee: Canon Kabushiki Kaisha, Tokyo, Japan

[21] Appl. No.: 452,545

[22] Filed: May 30, 1995

[30] Foreign Application Priority Data

May 30, 1994 [JP] Japan ..... 6-116733

[51] Int. Cl.[6] ..... G10L 3/02

[52] U.S. Cl. ..... 395/2.77; 395/2.75

[58] Field of Search ..... 395/2.14, 2.77, 395/2.78, 2.15, 2.16, 2.75, 2.17, 2.76, 2.67, 2.73, 2.2, 2.74, 2.09

[56] References Cited

U.S. PATENT DOCUMENTS

| | | | |
|---|---|---|---|
| 3,892,919 | 7/1975 | Ichikawa | 395/2.73 |
| 4,577,343 | 3/1986 | Oura | 395/2.73 |
| 4,885,790 | 12/1989 | McAulay et al. | 395/2.74 |
| 5,220,629 | 6/1993 | Kosaka et al. | 395/2.69 |
| 5,300,724 | 4/1994 | Medovich | 84/604 |
| 5,369,730 | 11/1994 | Yajima | 395/2.76 |
| 5,381,514 | 1/1995 | Aso et al. | 395/2.73 |
| 5,384,891 | 1/1995 | Asakawa et al. | 395/2.29 |
| 5,485,543 | 1/1996 | Aso | 395/2.76 |

FOREIGN PATENT DOCUMENTS

| | | | |
|---|---|---|---|
| 0577488 | 1/1994 | European Pat. Off. | G10L 9/18 |
| 9304467 | 3/1993 | WIPO | G10L 5/00 |

OTHER PUBLICATIONS

Prentice-Hall Signal rpocessing Series, Rabiner et al., "Digital processing of speech signals", pp. 306–310, 1978.

ICASSP-89: 1989 International Conference on Acoustics, Speech and Signal Processing, Asakawa et al., "Speech coding method using fuzzy vector quantization", pp. 755–758 vol. 2, May 1989.

*Primary Examiner*—Allen R. MacDonald
*Assistant Examiner*—Richemond Dorvil
*Attorney, Agent, or Firm*—Fitzpatrick, Cella, Harper & Scinto

[57] ABSTRACT

A speech synthesis method and a speech synthesis apparatus includes a system for synthesis by rule that prevents the quality of synthesized speech from deteriorating and for reducing the number of calculations that are required for the generation of a speech waveform. The speech synthesis apparatus includes a character series input section, for inputting a character series as phonetic text, a pitch waveform generator, for generating a pitch waveform by calculating a product of a matrix, which has been acquired for each pitch, and the character series, which is input by the character series input section, and a device for connecting pitch waveforms that are generated by the pitch waveform generator and for providing a speech waveform. The calculation method for the generation of such a pitch waveform provides a great reduction in the number of calculations that are required. In addition, in the calculation for the generation of a pitch waveform, a function that determines a frequency response is employed to convert a spectral envelope, which is obtained from a parameter, so that the timbres of synthesized speech can be changed without parameter operations.

12 Claims, 22 Drawing Sheets

DATA STRUCTURE FOR 1 FRAME OF PARAMETERS

| | |
|---|---|
| K | UTTERANCE SPEED COEFFICIENT |
| s | PITCH SCALE |
| p[0]~p[M-1] | SYNTHESIS PARAMETER |

$$\Delta_p(m) = \{p_{i+1}(m) - p_i(m)\}/N_i$$
$$p(m) = \{p_i(m) + n_w \Delta_p(m)$$

FIG. 16

DATA STRUCTURE FOR 1 FRAME OF PARAMETERS

| | |
|---|---|
| K | UTTERANCE SPEED COEFFICIENT |
| uvflag | VOICED/UNVOICED |
| s | PITCH SCALE |
| p[0]~p[M-1] | SYNTHESIS PARAMETER |

FIG. 19

DATA STRUCTURE FOR 1 FRAME OF PARAMETERS

| | |
|---|---|
| K | UTTERANCE SPEED COEFFICIENT |
| s | PITCH SCALE |
| p[0]~p[N-1] | SYNTHESIS PARAMETER |

$$\Delta_p(n) = \{p_{i+1}(n) - p_i(n)\}/N_i$$
$$p(n) = \{p_i(n) + n_w \Delta_p(n)$$

SPEECH SYNTHESIS APPARATUS AND METHOD FOR CAUSING A COMPUTER TO PERFORM SPEECH SYNTHESIS BY CALCULATING PRODUCT OF PARAMETERS FOR A SPEECH WAVEFORM AND A READ WAVEFORM GENERATION MATRIX

BACKGROUND OF THE INVENTION

1. Field of the Invention

The present invention relates to a speech synthesis method and a speech synthesis apparatus that employ a system for synthesis by rule.

2. Related Background Art

Conventional apparatuses for speech synthesis by rule employ, as a method for generating synthesized speech, a synthesis filter system (PARCOR, LESP, or MSLA), a waveform editing system, or a superposition system for an impulse response waveform.

Speech synthesis that is performed by a synthesis filter system requires many calculations before a speech waveform can be generated, and not only is the load that is placed on the apparatus large, but a long processing time is also required. As for speech synthesis performed by a waveform editing system, since a complicated process must be performed to change the tones of synthesized speech, the load placed on the apparatus is large, and because a complicated waveform editing process must be performed, the quality of the synthesized speech deteriorates compared with the one before editing.

Speech synthesis that is performed by an impulse response waveform superposition system causes a deterioration in the quality of sounds in portions where waveforms are superposed.

By employing the above described conventional techniques, performing a process for generating a speech waveform with a pitch period that is not an integer times as large as a sampling cycle is difficult, and therefore, synthesized speech at an exact pitch can not be acquired.

As with the above described conventional techniques, a process for increasing/decreasing sampling speeds and a process using a low-pass filter must be performed for conversion of the sampling frequencies of synthesized speech, and the processing that is required is complicated and the number of calculations that must be performed is large.

When using the above described conventional techniques, parameter operations within frequency ranges can not be performed, and it is difficult for an operator to visualize the operation.

According to the above described conventional techniques, as parameter operations must be performed to change the timbre of synthesized speech, such processing becomes very complicated.

According to the above described conventional techniques, all the waveforms for synthesized speech must be generated by the synthesis filter system, the waveform editing system, and the superposition system of impulse response waveforms. As a result, the number of calculations that must be performed is enormous.

SUMMARY OF THE INVENTION

To overcome the above described shortcomings, it is an object of the present invention to provide a speech synthesis method and a speech synthesis apparatus that prevent the deterioration of the quality of synthesized speech and that reduce the number of calculations that are required for generation of a speech waveform.

It is another object of the present invention to provide a speech synthesis method and a speech synthesis apparatus that provide synthesized speech that has an accurate pitch.

It is an additional object of the present invention to provide a speech synthesis method and a speech synthesis apparatus that reduce the number of calculations that are required for the conversion of a sampling frequency of a synthesized speech.

To achieve the above objects, a speech synthesis apparatus comprises:

generation means for generating pitch waveforms by employing a pitch and a parameter of synthesized speech and for connecting the pitch waveforms to provide a speech waveform; and generation means for generating an unvoiced waveform using a parameter of synthesized speech and for connecting the unvoiced waveforms to provide a speech waveform that can prevent the deterioration of sound quality for an unvoiced waveform.

A product of a matrix, which is acquired in advance, and a parameter is calculated for each pitch in the process for generating a pitch waveform, so that the number of calculations that are required for the generation of a speech waveform can be reduced.

A product of a matrix, which is acquired in advance, and a parameter is calculated for the generation of unvoiced speech, so that the number of calculations that are required for the generation of an unvoiced waveforms can be reduced.

Pitch waveforms, having shifted phases, are generated and linked together to represent a decimal portion of a pitch period point number, so that the exact pitch can be provided for a speech waveform in which is included a decimal portion.

Since a parameter (impulse response waveform) that is acquired at a specific sampling frequency is employed to generate pitch waveforms for arbitrary sampling frequencies and to link them together, synthesized speech for an arbitrary sampling frequency can be generated by a simple method.

For the generation of a pitch waveform, a mathematical function that determines a frequency response is employed to multiply a function value an integer times a pitch frequency, and a sample value for a spectral envelope, which is obtained by using a parameter, is transformed. Fourier transform is performed on the resultant, transformed sample value to provide a pitch waveform, so that the timbre of synthesized speech can be changed without performing a complicated process, such as a parameter operation.

Since symmetry of a waveform is used for the generation of a pitch waveform, the number of calculations that are required for the generation of a speech waveform can be reduced.

According to the present invention, since a power spectrum envelope for speech is employed as a parameter for the generation of a pitch waveform, a speech waveform can be generated by using a parameter in a frequency range and a parameter operation in the frequency range can be performed.

According to the present invention, for the generation of a pitch waveform, a function that decides a frequency response is employed to multiply a function value an integer times a pitch frequency, and a sample value of a spectral envelope that is acquired by a parameter is transformed. Then, a Fourier transform is performed on the transformed sample value to generate a pitch waveform, so that the timbre of the synthesized speech can be altered without parameter operations.

BRIEF DESCRIPTION OF THE DRAWINGS

FIG. 16 is a diagram showing the data structure of 1 frame of parameters;

FIG. 19 is a diagram illustrating the data structure of 1 frame of parameters;

DETAILED DESCRIPTION OF THE PREFERRED EMBODIMENTS

(Embodiment 1)

Figure 25:
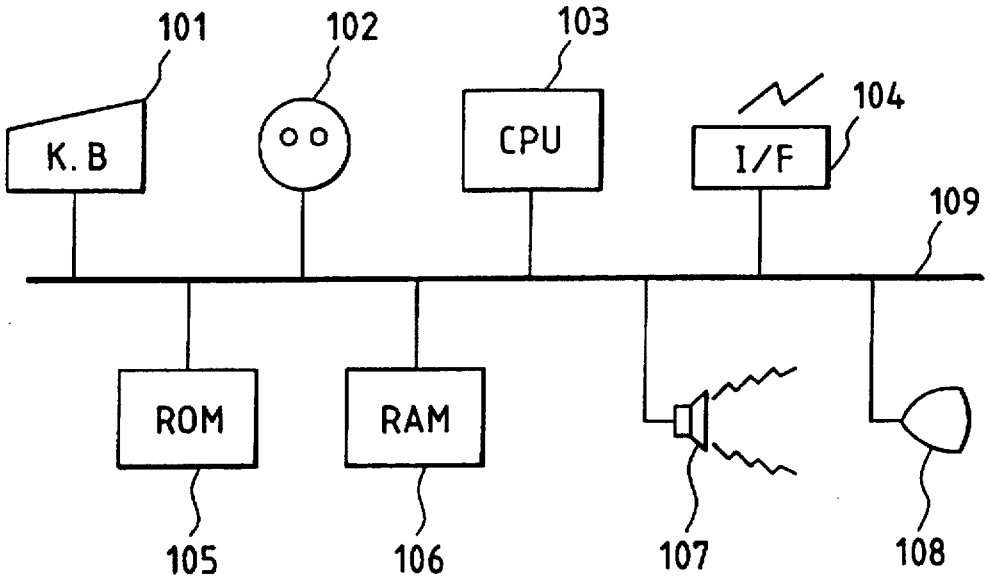
FIG. 25 is a block diagram illustrating the arrangement of a speech synthesis apparatus according to the embodiment of the present invention.

FIG. 25 is a block diagram illustrating the arrangement of a speech synthesis apparatus according to one embodiment of the present invention.

A keyboard (KB) 101 is employed to input text for synthesized speech and to input control commands, etc. A pointing device 102 is employed to input a desired position on the display screen of a display 108; by positioning a pointing icon with this device, desired control commands, etc., can be input. A central processing unit (CPU) 103 controls various processes, in the embodiment that will be described later, that are executed by the apparatus of the present invention, and performs processing by executing a control program that is stored in a read only memory (ROM) 105. A communication interface (I/F) 104 is employed to control the transmission and the reception of data across various communication networks. The ROM 105 is employed for storing a control program for a process that is shown in a flowchart for this embodiment. A random access memory (RAM) 106 is employed as a means for storing data that are generated by various processes in the embodiment. A loudspeaker 107 is used to output sounds, such as synthesized speech and messages for an operator. The display 108, an apparatus such as an LCD or a CRT, is employed to display text that are input at the keyboard and data that are being processed. A bus 109 is used to transfer data and commands between the individual components.

Figure 1:
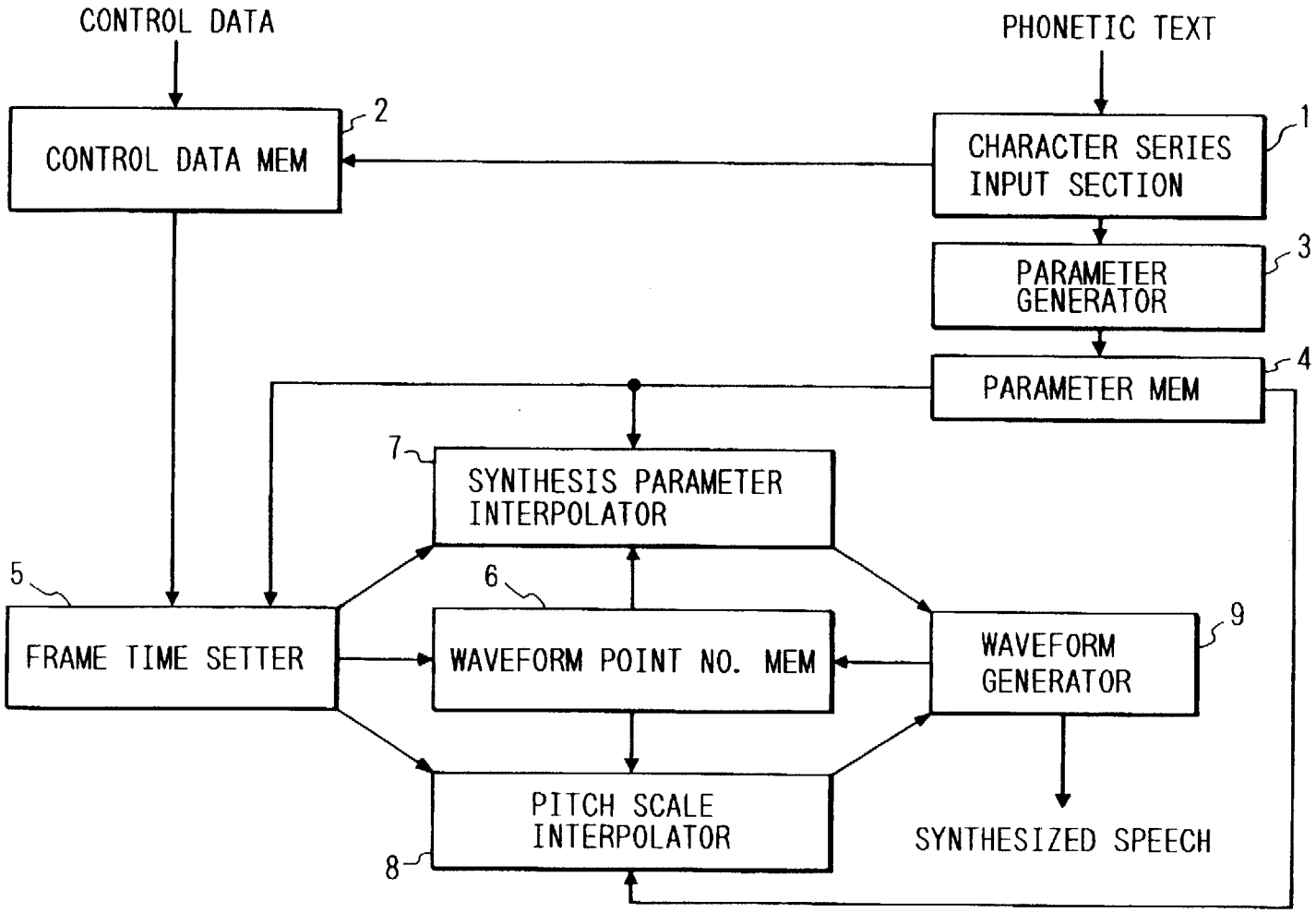
FIG. 1 is a block diagram illustrating the arrangement of functions of components in a speech synthesis apparatus according to one embodiment of the present invention.

FIG. 1 is a block diagram illustrating the functional arrangement of a synthesis apparatus according to Embodiment 1 of the present invention. These functions are executed under the control of the CPU 103 in FIG. 25. A character series input section 1 inputs a character series for a speech that is to be synthesized. When speech to be synthesized is "あいうえお," for example, a character series of phonetic text, such as "AIUEO", is input. Aside from phonetic text, character series that are input by the character series input section 1 indicate control sequences that are for determining utterance speeds and pitches. The character series input section 1 determines whether or not an input character series is phonetic text or a control sequence. Character series that are determined as control sequences by the character series input section 1, and control data for utterance speeds and pitches that are input via a user interface are transmitted to a control data memory 2 and stored in the internal register of the control data memory 2. For generation of a parameter series, a parameter generator 3 reads a parameter series, which is stored in advance from the ROM 105 in consonance with a character series that is input by the character series input section 1 and that is determined to be phonetic text. A parameter of a frame that is to be processed is extracted from the parameter series that is generated by the parameter generator 3 and is stored in the internal register of a parameter memory 4. A frame time setter 5 calculates time length Ni for each frame by employing control data that concern utterance speeds and that are stored in the control data memory 2, and utterance speed coefficient K (a parameter used for determining a frame time length in consonance with utterance speed), which is stored in the parameter memory 4. A waveform point number memory 6 is employed to store in its internal register acquired waveform point number $n_w$ for one frame. A synthesis parameter interpolator 7 interpolates synthesis parameters, which are stored in the parameter memory 4, by using frame time length Ni, which is set by the frame time setter 5, and waveform point number $n_w$, which is stored in the waveform point number memory 6. A pitch scale interpolator 8 interpolates pitch scales, which are stored in the parameter memory 4, by using frame time length Ni, which is set by the frame time setter 5, and waveform point number $n_w$, which is stored in the waveform point number memory 6. A waveform generator 9 generates a pitch waveform by using a synthesis parameter, which has been interpolated by the synthesis parameter interpolator 7, and a pitch scale, which has been interpolated by the pitch scale interpolator 8, and links the pitch waveforms to output synthesized speech.

Processing of the waveform generator 9 for generating a pitch waveform will now be described while referring to FIGS. 2 through 6.

Figure 2:
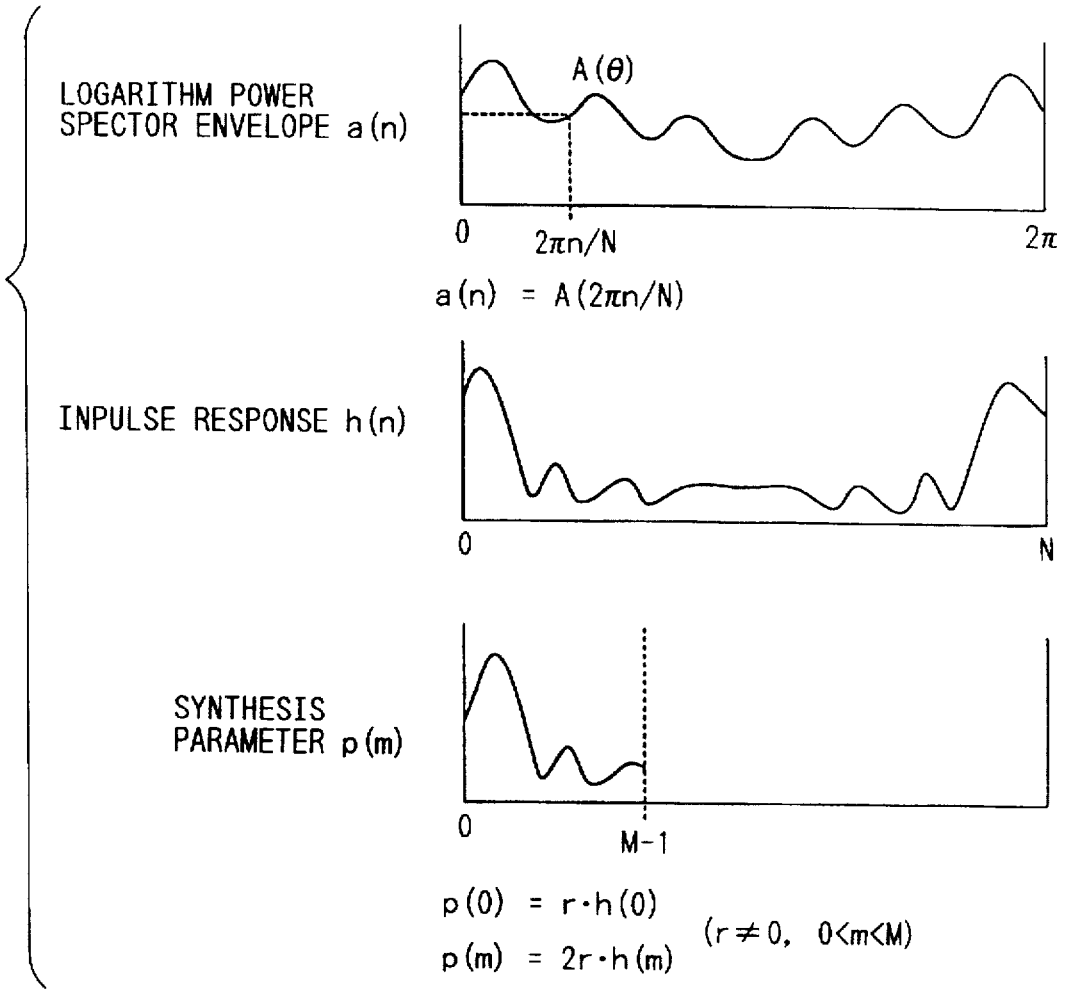
FIG. 2 is an explanatory diagram for a synthesis parameter according to the embodiment of the present invention.
Figure 3:
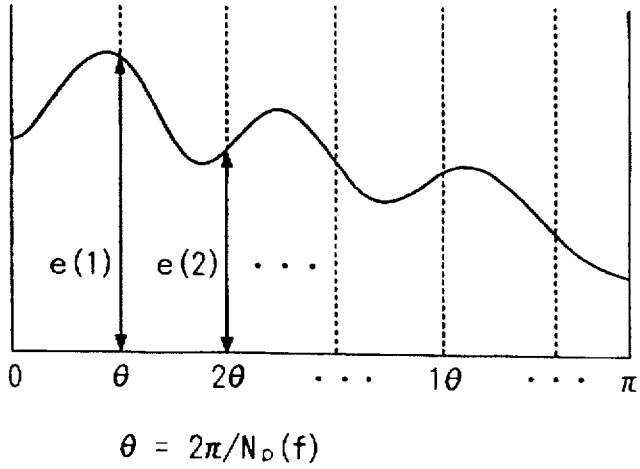
FIG. 3 is an explanatory diagram for a spectral envelope according to the embodiment of the present invention.
Figure 4:
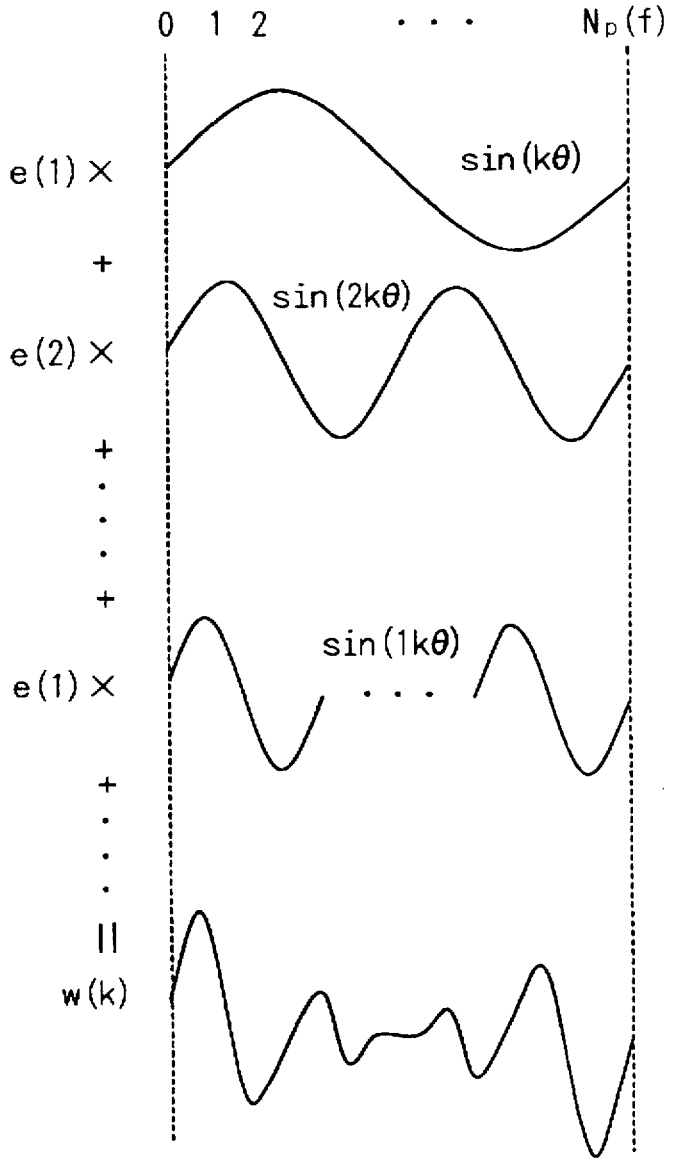
FIG. 4 is an explanatory diagram for the superposition of sine waves.
Figure 5:
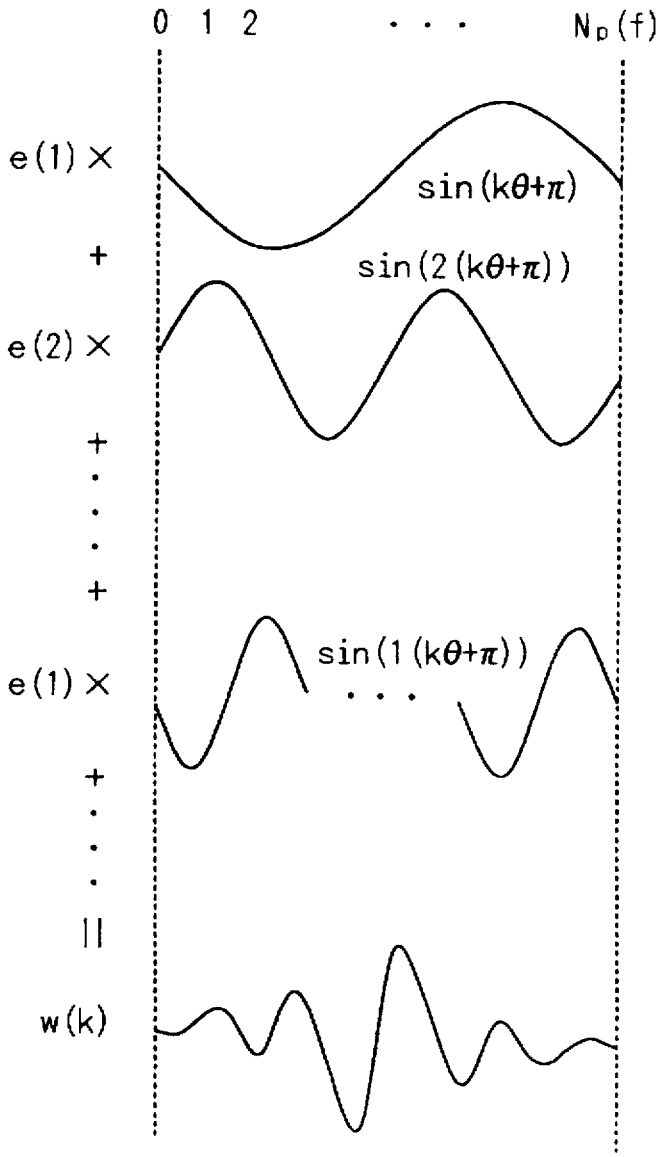
FIG. 5 is an explanatory diagram for the superposition of sine waves.
Figure 6:
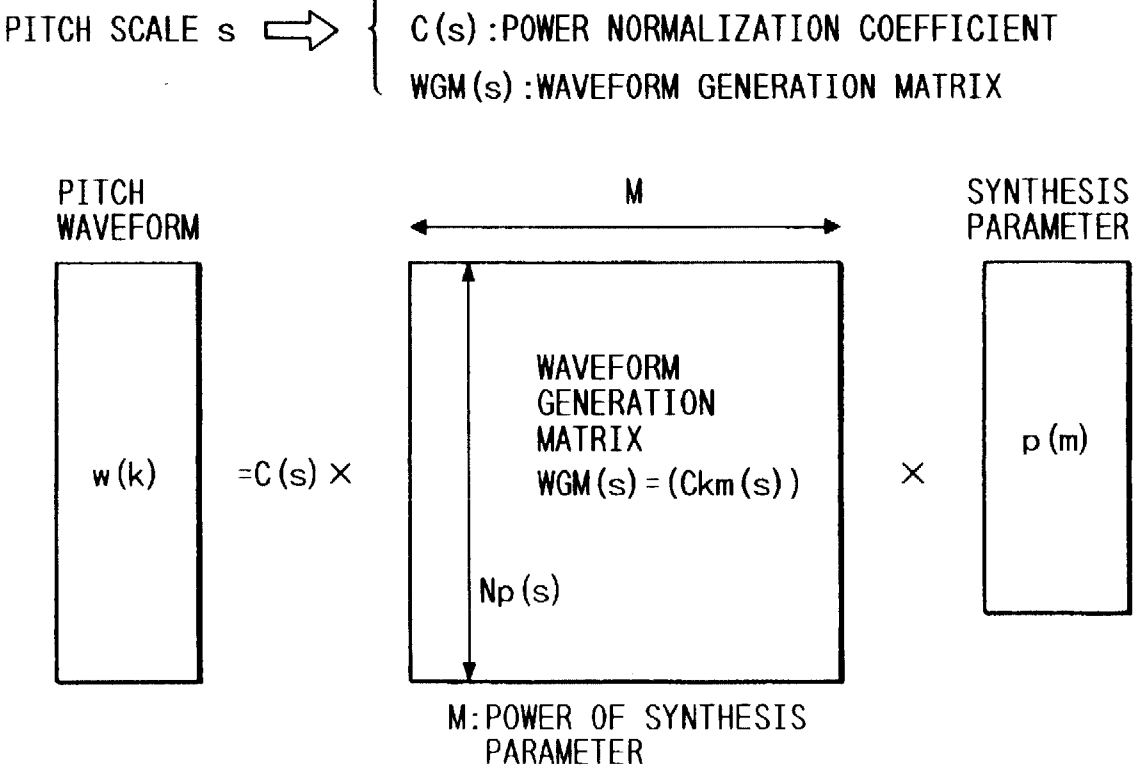
FIG. 6 is an explanatory diagram for the generation of a pitch waveform.

A synthesis parameter that is employed for the generation of a pitch waveform will be explained. In FIG. 2, with the power of the Fourier transform is denoted by N, and the power of a synthesis parameter is denoted by M, N and M satisfy N≧2M. Suppose that a logarithm power spectrum envelope for speech is $$a(n) = A\left(\frac{2\pi n}{N}\right)(0 \leqq n < N).$$

The logarithm power spectrum envelope is substituted in an exponentional function to return the envelope to a linear form, and a reverse Fourier transform is performed on the resultant envelope. The acquired impulse response is $$h(n) = \frac{1}{N}\sum_{k=0}^{N-1}\exp(a(k))\cos\left(\frac{2\pi kn}{N}\right)(0 \leqq n < N).$$

Synthesis parameter $$p(m)\ (0 \leqq m < M)$$

is acquired by doubling the ratio of a value of the power of 0 of the impulse response and a value of the power of 1 and the following number of the impulse response. In other words, with r≠0, $$p(0) = rh(0)$$

$$p(m) = 2rh(m)(1 < m < M).$$

With a sampling frequency of $f_s$, a sampling period is $$T_s = \frac{1}{f_s}.$$

When a pitch frequency of synthesized speech is f, a pitch period is $$T = \frac{1}{f},$$

and the pitch period point number is $$N_p(f) = f_s T = \frac{T}{T_s} = \frac{f_s}{f}.$$

[x] represents an integer that is equal to or smaller than x, and the pitch period point number, which is quantized by using an integer, is expressed as $$N_p(f) = [N_p(f)].$$

When the pitch period corresponds to angle 2π, an angle for each point is represented by θ, $$\theta = \frac{2\pi}{N_p(f)}.$$

The value of a spectral envelope that is an integer times as large as the pitch frequency is expressed as follows (FIG. 3):

$$e(1) = \sum_{m=0}^{M-1} p(m)\cos(ml\theta)(1 \leqq l \leqq [N_p(f)/2]).$$

A pitch waveform is $$w(k)(0 \leqq k < N_p(f)),$$

and a power normalization coefficient that corresponds to pitch frequency f is $$C(f).$$

When a pitch frequency with which C (f)=1.0 is established is $f_0$, the following equation provides C(f):

$$C(f) = \sqrt{\frac{f}{f_0}}.$$

Sine waves that are integer times of a fundamental frequency are superposed, and by the following expression, pitch waveform w (k) ($0 \leqq k < N_p$ (f)) can be generated (FIG. 4):

$$w(k) = C(f)\sum_{l=1}^{[N_p(f)/2]} e(1)\sin(lk\theta) \tag{1}$$

$$w(k) = C(f)\sum_{l=1}^{[N_p(f)/2]} \sin(lk\theta)\sum_{m=0}^{M-1} p(m)\cos(ml\theta)$$

$$w(k) = C(f)\sum_{m=0}^{M-1} p(m)\sum_{l=1}^{[N_p(f)/2]} \sin(lk\theta)\cos(ml\theta)$$

Or, the sine waves are superposed with half of a phase of the pitch period being shifted, and by the following expression, pitch waveform w (k) ($0 \leqq k < N_p$ (f)) can be generated (FIG. 5):

$$w(k) = C(f)\sum_{l=1}^{[N_p(f)/2]} e(1)\sin(l(k\theta + \pi)) \tag{2}$$

$$w(k) = C(f)\sum_{l=1}^{[N_p(f)/2]} \sin(l(k\theta + \pi))\sum_{m=0}^{M-1} p(m)\cos(ml\theta)$$

$$w(k) = C(f)\sum_{m=0}^{M-1} p(m)\sum_{l=1}^{[N_p(f)/2]} \sin(l(k\theta + \pi))\cos(ml\theta)$$

The pitch scale is employed as a scale for representing the tone of speech. Instead of calculating expressions (1) and (2), the speed of calculation can be increased as follows: with $N_p$ as a pitch period point number that corresponds to pitch scale s, $$\theta = \frac{2\pi}{N_p(S)},$$

-continued $$C_{km}(s) = \sum_{l=1}^{[N_p(S)/2]} \sin(lk\,\theta)\cos(ml\,\theta),$$

is calculated for expression (1), and $$C_{km}(s) = \sum_{l=1}^{[N_p(S)/2]} \sin(l(k\,\theta + \pi))\cos(ml\,\theta),$$

is calculated for expression (2), and these results are stored in a table. A waveform generation matrix is $$WGM(s)=(c_{km}(s))\ (0 \leqq k < N_p(s),\ 0 \leqq m < M).$$

In addition, pitch period point number $N_p$ (s) and power normalization coefficient C (s) that correspond to pitch scale s are stored in a table.

By employing, as input data, the synthesis parameter p (m) ($0 \leqq m < M$), which is output by the synthesis parameter interpolator 7, and pitch scale s, which is output by the pitch scale interpolator 8, from the table the waveform generator 9 reads pitch period point number $N_p$ (s), power normalization coefficient C (s), and waveform generation matrix WGM (s)=($c_{km}$ (s)), and generates a pitch waveform (FIG. 6) by using the following equation:

$$w(k) = C(s) \sum_{m=0}^{M-1} c_{km}(s)p(m)\ (0 \leqq k < N_p(s)).$$

Figure 7:
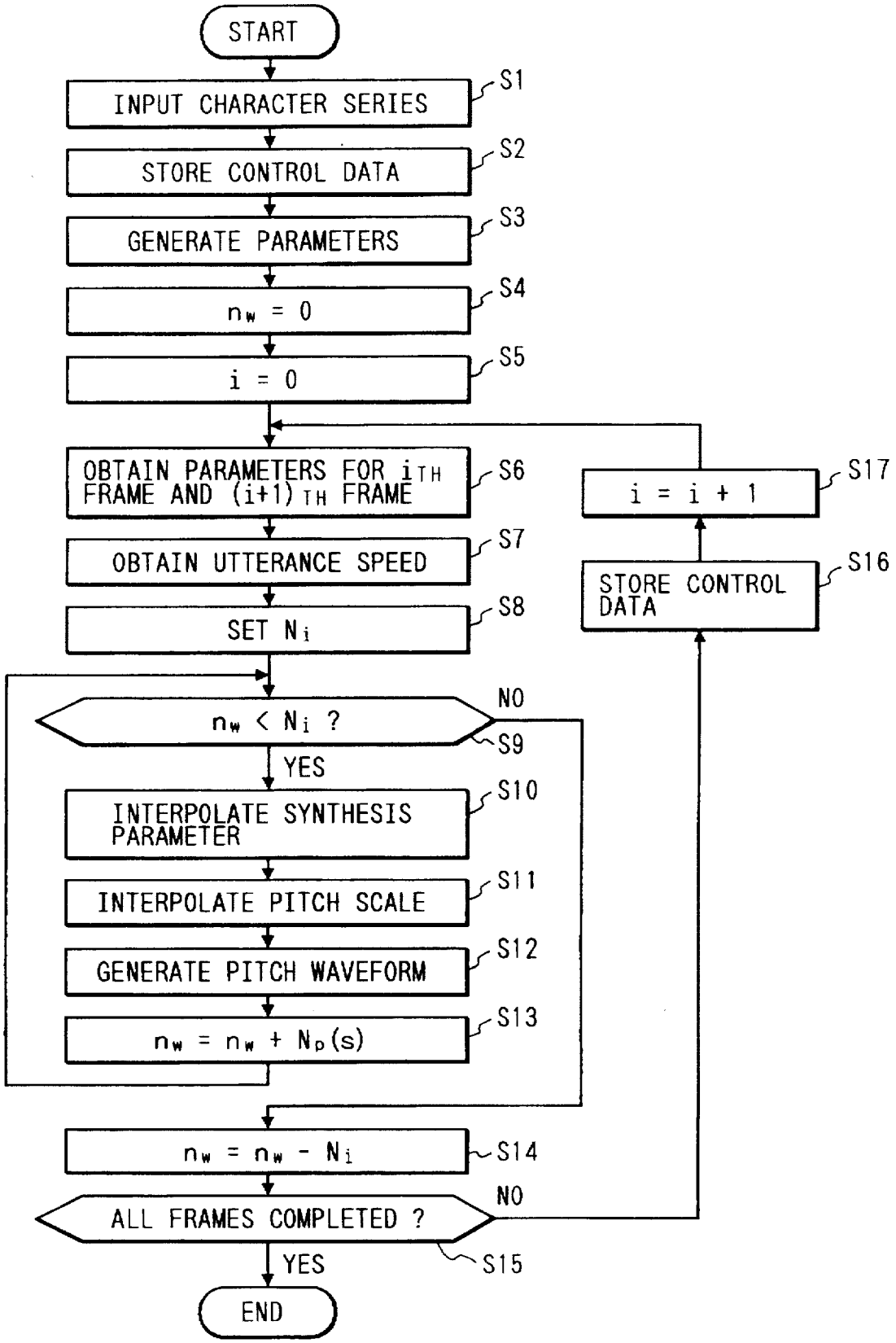
FIG. 7 is a flowchart showing a speech waveform generating process.

The process, beginning with the input of phonetic text and continuing until the generation of a pitch waveform, will now be described while referring to the flowchart in FIG. 7.

At step S1, phonetic text is input by the character series input section 1.

At step S2, control data (utterance speed, pitch of speech, etc.) that are externally input, and control data for the input phonetic text are stored in the control data memory 2.

At step S3, the parameter generator 3 generates a parameter series for the phonetic text that has been input by the character series input section 1.

Figures 8, 9:
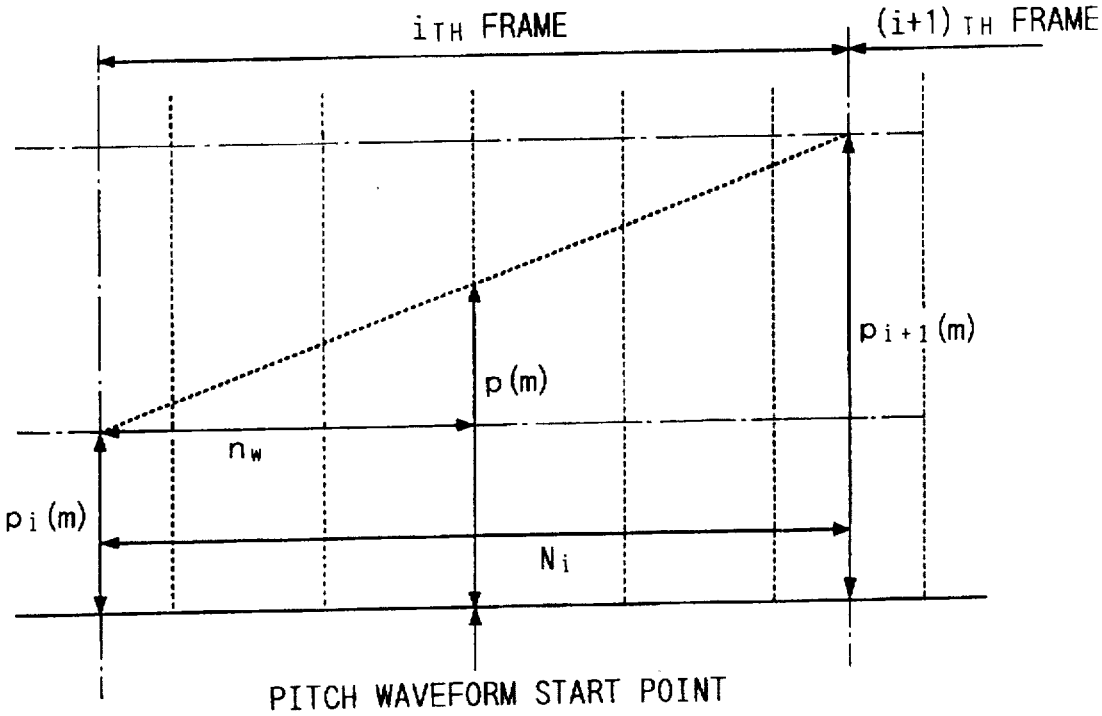
FIG. 8 is a diagram showing the data structure of 1 frame of parameters.
FIG. 9 is an explanatory diagram for interpolation of synthesis parameters.

A data structure example for one frame of parameters that are generated at step S3 is shown in FIG. 8.

At step S4, the internal register of the waveform point number memory 6 is set to 0. The waveform point number is represented by $n_w$ as follows:

$$n_w=0.$$

At step S5, parameter series counter i is initialized to 0.

At step S6, parameters for the ith frame and the (i+1)th frame are fetched from the parameter generator 3 to the internal register of the parameter memory 4.

At step S7, utterance speed is fetched from the control data memory 2 to the frame time setter 5.

At step S8, the frame time setter 5 employs utterance speed coefficients for the parameters, which have been fetched to the parameter memory 4, and utterance speed that has been fetched from the control data memory 2 to set frame time length Ni.

At step S9, a check is performed to ascertain whether or not waveform point number $n_w$ is smaller than frame time length Ni in order to determine whether or not the process for the ith frame has been completed. When $n_w \geqq Ni$, it is assumed that the process for the ith frame has been completed, and program control advances to step S14. When $n_w < Ni$, it is assumed that the process for the ith frame is in the process of being performed and program control moves to step S10 where the process is continued.

At step S10, the synthesis parameter interpolator 7 employs the synthesis parameter, which is stored in the parameter memory 4, the frame time length, which is set by the frame time setter 5, and the waveform point number, which is stored in the waveform point number memory 6, to perform interpolation for the synthesis parameter. FIG. 9 is an explanatory diagram for the interpolation of the synthesis parameter. A synthesis parameter for the ith frame is denoted by pi [m] ($0 \leqq m < M$), a synthesis parameter for the (i+1)th frame is denoted by $p_{i+1}$ [m] ($0 \leqq m < M$), and the time length for the ith frame is denoted by $N_i$ point. A difference $\Delta_p$ [m] ($0 \leqq m < M$) of a synthesis parameter for each point is $$\Delta_p[m] = \frac{p_{i+1}[m] - p_i[m]}{N_i}.$$

Then, synthesis parameter p [m] ($0 \leqq m < M$) is updated each time a pitch waveform is generated. The process $$p[m]=p_i[m]+n_w\Delta_p[m] \tag{3}$$

is performed at the starting point for a pitch waveform.

Figure 10:
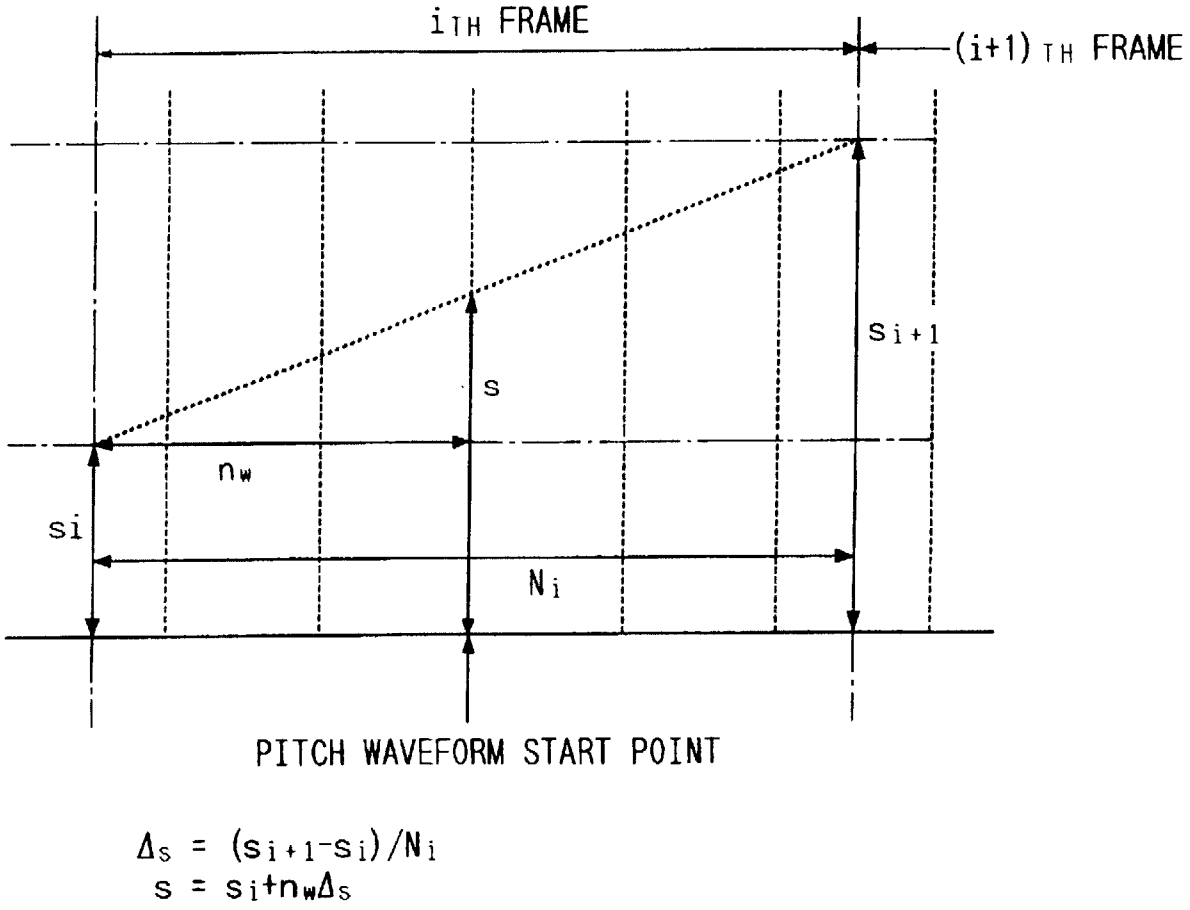
FIG. 10 is an explanatory diagram for interpolation of pitch scales.

At step S11, the pitch scale interpolator 8 employs the pitch scale, which is stored in the parameter memory 4, the frame time length, which is set by the frame time setter 5, and the waveform point number, which is stored in the waveform point number memory 6, to interpolate the pitch scale. FIG. 10 is an explanatory diagram for the interpolation of pitch scales. Suppose that a pitch scale for the ith frame is $s_i$, a pitch scale of the (i+1)th frame is $s_{i+1}$, and the $N_i$ point is a frame time length for the ith frame. Difference $\Delta_s$ of a pitch scale for each point is represented as $$\Delta_s = \frac{s_{i+1} - s_i}{N_i}.$$

Then, pitch scale s is updated each time a pitch waveform is generated. The process $$s=s_i+n_w\Delta_s \tag{4}$$

is performed at the starting point for a pitch waveform.

At step S12, the waveform generator 9 employs synthesis parameter p [m] ($0 \leqq m < M$), which is obtained from equation (3), and pitch scale s, which is obtained from equation (4), to generate a pitch waveform. The waveform generator 9 reads, from the table, pitch period point number $N_p$ (s), power normalization coefficient C (s), and waveform generation matrix WGM (s)=($c_{km}$ (s)) ($0 \leqq k < N_p$ (s), $0 \leqq m < M$), which correspond to pitch scale s, and generates a pitch waveform with the following expression:

$$w(k) = C(s) \sum_{m=0}^{M-1} c_{km}(s)p(m)(0 \leqq k < N_p(s)).$$

Figure 11:
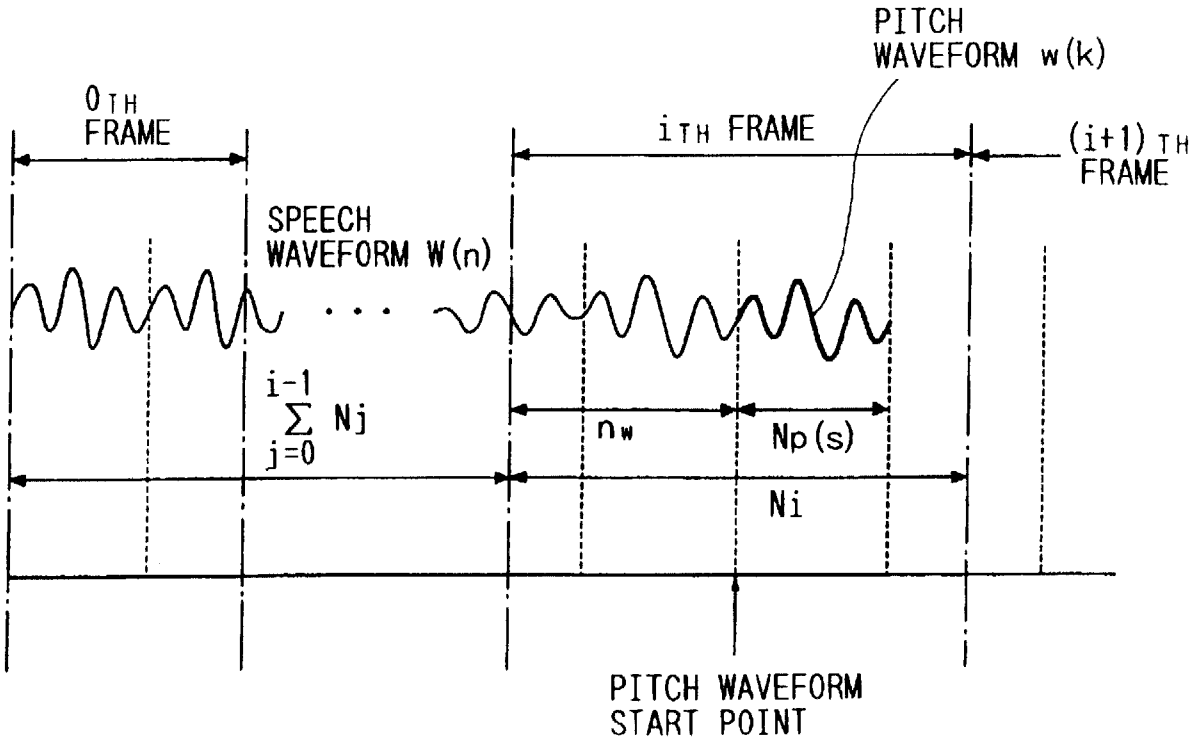
FIG. 11 is an explanatory diagram for linking waveforms.

FIG. 11 is an explanatory diagram for the linking of generated pitch waveforms. A speech waveform that is output as synthesized speech by the waveform generator 9 is represented as $$W(n)\ (0 \leqq n).$$

The pitch waveforms are linked by the following equations:

$$W(n_w + k) = w(k)(i = 0, 0 \leqq k < N_p(s))$$

$$W\left(\sum_{j=0}^{i-1} N_j + n_w + k\right) = w(k)(i > 0, 0 \leqq k < N_p(s)).$$

At step S13, in the waveform point number memory 6, the waveform point number $n_w$ is updated by $$n_w = n_2 + N_p(s),$$

program control returns to step S9, and the processing is repeated.

When, at step S9, $n_w \geqq N_i$, program control goes to step S14.

At step S14, the waveform point number $n_w$ is initialized as $$n_w = n_w - N_i.$$

At step S15, a check is performed to determine whether or not the process for all the frames has been completed. When the process is not yet completed, program control goes to step S16.

At step S16, the control data (utterance speed, pitch of speech, etc.) that are input externally are stored in the control data memory 2. At step S17, parameter series counter i is updated as $$i = i + 1.$$

Program control then returns to step S6 and the processing is repeated.

When, at step S15, the process for all the frames has been completed, the processing is thereafter terminated.

(Embodiment 2)

As they are for Embodiment 1, the structure and the functional arrangement of a speech synthesis apparatus according to Embodiment 2 are shown in the block diagrams in FIGS. 25 and 1.

In this embodiment, an explanation will be given for an example where pitch waveforms whose phases are shifted are generated and linked in order to represent the decimal portion of a pitch period point number.

The processing by the waveform generator 9 for the generation of a pitch waveform will be described while referring to FIG. 12.

Suppose that a synthesis parameter that is employed for generation of a pitch waveform is $$p(m)\ (0 \leqq m < M)$$

and a sampling frequency is $f_s$. A sampling period then is $$T_s = \frac{1}{f_s}.$$

When a pitch frequency of synthesized speech is f, a pitch period is $$T = \frac{1}{f},$$

and the pitch period point number is $$N_p(f) = f_s T = \frac{T}{T_s} = \frac{f_s}{f}.$$

The notation [x] represents an integer that is equal to or smaller than x.

The decimal portion of a pitch period point number is represented by linking pitch waveforms that are shifted in phase. The number of pitch waveforms that correspond to frequency f is the number of phases $$n_p(f).$$

Figure 12:
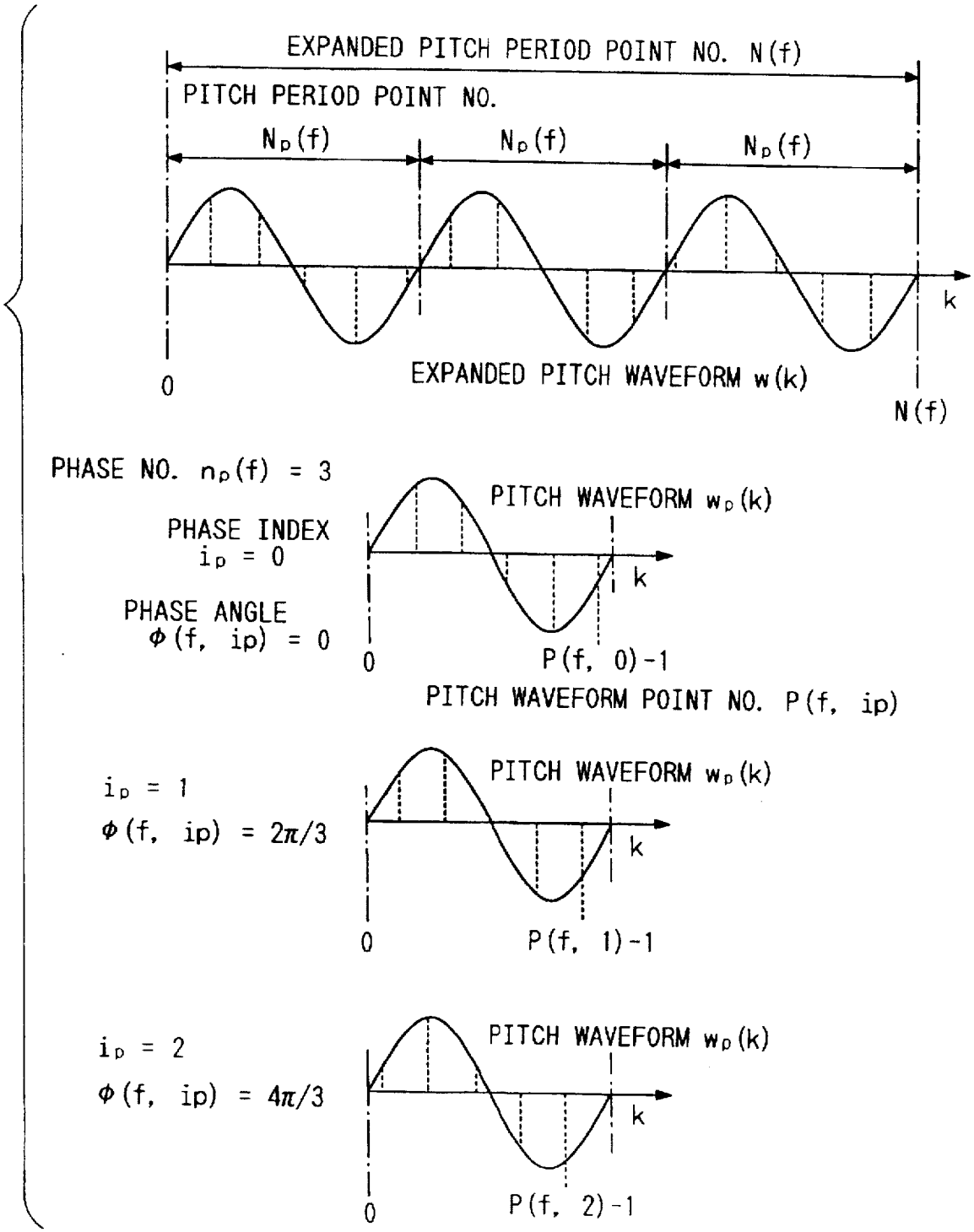
FIG. 12 is an explanatory diagram for a pitch waveform.

An example in FIG. 12 is a pitch waveform with $n_p$ (f)=3. Further, an expanded pitch period point number is expressed as $$N(f) = [n_p(f) N_p(f)] = \left[ n_p(f) \frac{f_s}{f} \right]$$

and a pitch period point number is quantized to obtain $$N_p(f) = \frac{N(f)}{n_p(f)}.$$

With $\theta_1$ as an angle for each point when the pitch period point number corresponds to angle $2\pi$, $$\theta_1 = \frac{2\pi}{N_p(f)}.$$

The value of a spectral envelope that is integer times as large as the pitch frequency is an expressed as follows:

$$e(1) = \sum_{m=0}^{M-1} p(m) \cos(ml\theta_1)(1 \leqq l \leqq [N_p(f)/2]).$$

With $\theta_2$ as an angle for each point when the expanded pitch period point number corresponds to $2\pi$, $$\theta_2 = \frac{2\pi}{N(f)}.$$

The expanded pitch waveform is $$w(k)\ (0 \leqq k < N(f)),$$

and a power normalization coefficient that corresponds to pitch frequency f is $$C(f).$$

When a pitch frequency with which C(f)=1.0 is established is $f_0$, the following equation provides C(f):

$$C(f) = \sqrt{\frac{f}{f_0}}.$$

Sine waves that are integer times of a pitch frequency are superposed, and expanded pitch waveform w (k) (0≦k<N (f)) can be generated by using the following expression:

$$w(k) = C(f) \sum_{l=1}^{[N_p(f)/2]} e(l)\sin(lkn_p(f)\theta_2) \tag{5}$$

$$w(k) = C(f) \sum_{l=1}^{[N_p(f)/2]} \sin(lkn_p(f)\theta_2) \sum_{m=0}^{M-1} p(m)\cos(ml\theta_1)$$

$$w(k) = C(f) \sum_{m=0}^{M-1} p(m) \sum_{l=1}^{[N_p(f)/2]} \sin(lkn_p(f)\theta_2)\cos(ml\theta_1)$$

Or, the sine waves are superposed with half a phase of the pitch period being shifted, and expanded pitch waveform w (k) ($0 \leqq k < N$ (f)) can be generated by using the following expression:

$$w(k) = C(f) \sum_{l=1}^{[N_p(f)/2]} e(l)\sin(l(kn_p(f)\theta_2 + \pi)) \tag{6}$$

$$w(k) = C(f) \sum_{l=1}^{[N_p(f)/2]} \sin(l(kn_p(f)\theta_2 + \pi)) \sum_{m=0}^{M-1} p(m)\cos(ml\theta_1)$$

$$w(k) = C(f) \sum_{m=0}^{M-1} p(m) \sum_{l=1}^{[N_p(f)/2]} \sin(l(kn_p(f)\theta_2 + \pi))\cos(ml\theta_1)$$

Suppose that a phase index is $$i_p (0 \leqq i_p < n_p(f)).$$

A phase angle that corresponds to pitch frequency f and phase index $i_p$ is defined as:

$$\phi(f, i_p) = \frac{2\pi}{n_p(f)} i_p.$$

The statement a mod b is defined as representing the remainder following the division of a by b as in $$r(f, i_p) = i_p N(f) \bmod n_p(f).$$

The pitch waveform point number that corresponds to phase index $i_p$ is calculated by the equation of:

$$P(f, i_p) = \left[\frac{(i_p+1)N(f)}{n_p(f)}\right] - \left[1 - \frac{r(f, i_p+1)}{n_p(f)}\right] - \left[\frac{i_p N(f)}{n_p(f)}\right] + \left[1 - \frac{r(f, i_p)}{n_p(f)}\right].$$

A pitch waveform that corresponds to phase index $i_p$ is defined as $$w_p(k) = \begin{cases} w(k) & (i_p = 0, 0 \leqq k < P(f, i_p)) \\ w\left(\sum_{j=0}^{i_p-1} P(f,j) + k\right) & (0 < i_p < n_p(f), 0 \leqq k < P(f, i_p)) \end{cases}$$

Then, the phase index is updated to $$i_p = (i_p + 1) \bmod n_p(f),$$

and the updated phase index is employed to calculate a phase angle to establish $$\phi_p = \phi(f, i_p).$$

When a pitch frequency is altered to f' for the generation of the next pitch waveform, a value of i' is calculated to satisfy $$|\phi(f, i') - \phi_p| = \min_{0 \leqq i < n_p(f)} |\phi(f, i) - \phi_p|$$

in order to acquire a phase angle that is the closest to $\phi_p$, and $i_p$ is determined as $$i_p = i'.$$

The pitch scale is employed as a scale for representing the tone of speech. Instead of calculating expressions (5) and (6), the speed of calculation can be increased as follows. When $n_p$ (s) is a phase number that corresponds to pitch scale $s \in S$ (S denotes a set of pitch scales), $i_p$ ($0 \leqq i_p < n_p$ (s)) is a phase index, N (s) is an expanded pitch period point number, $N_p$ (s) is a pitch period point number, and P (s, $i_p$) is a pitch waveform point number, with the following equation $$\theta_1 = \frac{2\pi}{N_p(s)}$$

$$\theta_2 = \frac{2\pi}{N(s)},$$

for equation (5), $$c_{km}(s, i_p) = \begin{cases} \sum_{l=1}^{[N_p(S)/2]} \sin(lkn_p(S)\theta_2)\cos(1ml\theta_1) & (i_p = 0) \\ \sum_{l=1}^{[N_p(S)/2]} \sin\left(l\left(\sum_{j=0}^{i_p-1} P(s,j) + k\right) n_p(S)\theta_2\right)\cos(ml\theta_1) & (0 < i_p < n_p(S)) \end{cases}$$

is calculated, and for equation (6), $$c_{km}(s,i_p)=\begin{cases}\sum_{l=1}^{[N_p(S)/2]}\sin(l(kn_p(s)\theta_2+\pi))\cos(ml\theta_1) & (i_p=0)\\ \sum_{l=1}^{[N_p(S)/2]}\sin\left(l\left(\left(\sum_{j=0}^{i_p-1}P(s,j)+k\right)n_p(S)\theta_2+\pi\right)\right)\cos(ml\theta_1) & (0<i_p<n_p(S))\end{cases}$$

is calculated, and the obtained results are stored in the table. A pitch scale generation matrix is defined as $$WGM(s,\ i_p)=(c_{km}(s,\ i_p))\ (0\leqq k<P(s,\ i_p),\ 0\leqq m<M).$$

A phase angle of $$\phi(s,i_p)=\frac{2\pi}{n_p(s)}\ i_p,$$

which corresponds to pitch scale s and phase index $i_p$, is stored in the table. With respect to pitch scale s and phase angle $\Phi_p$ ($\in\{\phi(s,\ i_p)|s\in S,\ 0\leqq i<n_p(s)\}$), such a relationship that provides $i_0$ to establish $$|\phi(s,i_0)-\phi_p|=\min_{0\leqq i<n_p(s)}|\phi(s,i)-\phi_p|$$

is defined as $$i_0=I(s,\ \phi_0),$$

and is stored in the table. Further, phase number $n_p$ (s), pitch waveform point number P (s, $i_p$), and power normalization coefficient C (s), each of which corresponds to pitch scale s and phase index $i_p$, are stored in the table.

In the waveform generator 9, the phase index that is stored in the internal register is defined as $i_p$, the phase angle is defined as $\phi_p$, and synthesis parameter p (m) ($0\leqq m<M$), which is output by the synthesis parameter interpolator 7, and pitch scale s, which is output by the pitch scale interpolator 8, are employed as input data, so that the phase index can be determined by the following equation:

$$i_p=I(s,\ \phi_p).$$

The waveform generator 9 then reads from the table pitch waveform point number P (s, $i_p$), power normalization coefficient C (s) and waveform generation matrix WGM (s, $i_p$)=($c_{km}$ (s, $i_p$)), and generates a pitch waveform by using the expression $$w_p(k)=C(s)\sum_{m=0}^{M-1}c_{km}(s,i_p)p(m)(0\leqq k<N_p(s,i_p)).$$

After the pitch waveform has been generated, the phase index is updated as follows:

$$i_p=(i_p+1)\bmod n_p(s),$$

and the updated phase index is employed to update the phase angle as follows:

$$\phi_p=\phi(s,\ i_p).$$

Figure 13:
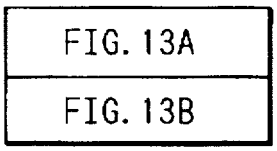
FIG. 13 is comprised of FIGS. 13A and 13B showing flowcharts of a speech waveform generation process.
Figure 13A:
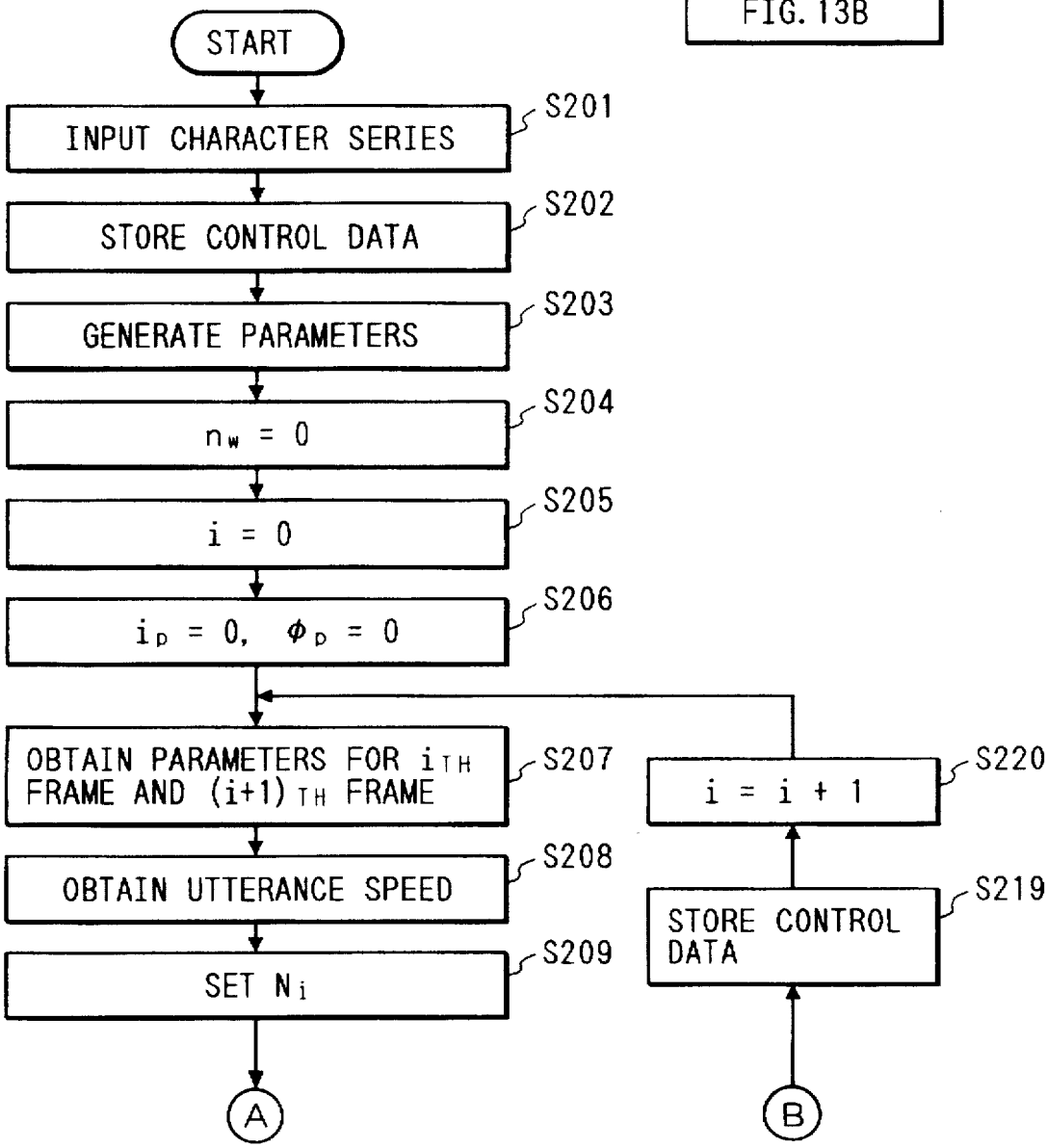
Figure 13B:
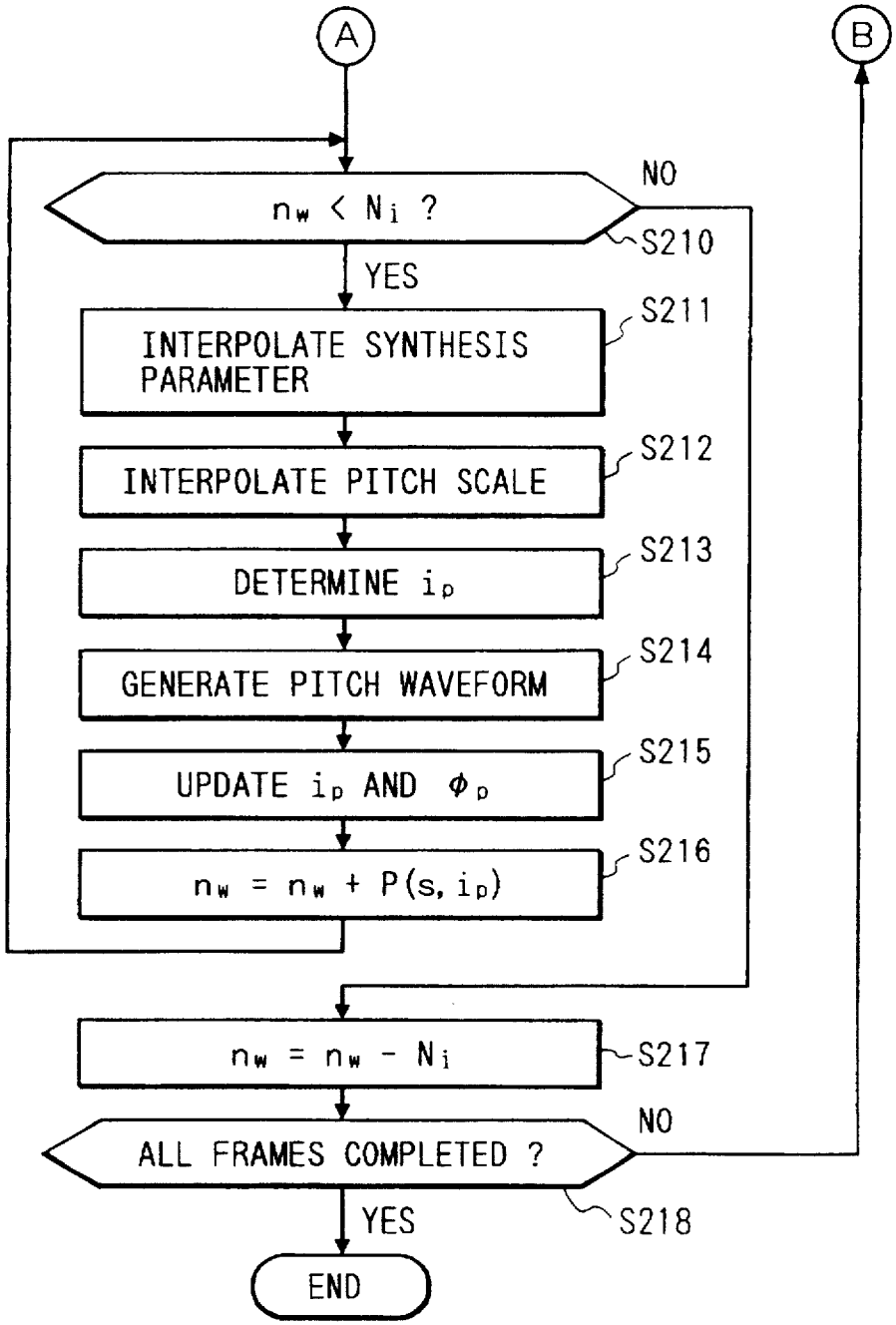

The above described process will now be described while referring to the flowchart in FIGS. 13A and 13B.

At step S201, phonetic text is input by the character series input section 1.

At step S202, control data (utterance speed, pitch of speech, etc.) that are externally input and control data for the input phonetic text are stored in the control data memory 2. At step S203, the parameter generator 3 generates a parameter series with the phonetic text that has been input by the character series input section 1.

The data structure for one frame of parameters that are generated at step S203 is the same as that of Embodiment 1 and is shown in FIG. 8.

At step S204, the internal register of the waveform point number memory 6 is set to 0. The waveform point number is represented by $n_w$ as follows:

$$n_w=0.$$

At step S205, parameter series counter i is initialized to 0.

At step S206, phase index $i_p$ is initialized to 0, and phase angle $\phi_p$ is initialized to 0.

At step S207, parameters for the ith frame and the (i+1)th frame are fetched from the parameter generator 3 and stored in the parameter memory 4.

At step S208, utterance speed data is fetched from the control data memory 2 for use by the frame time setter 5.

At step S209, the frame time setter 5 employs utterance speed coefficients for the parameters, which have been fetched into the parameter memory 4, and utterance speed data that have been fetched from the control data memory 2 to set frame time length Ni.

At step S210, a check is performed to determine whether or not waveform point number $n_w$ is smaller than frame time length Ni. When $n_w\geqq$Ni, program control advances to step S217. When $n_w$<Ni, program control moves to step S211 where the process is continued.

At step S211, the synthesis parameter interpolator 7 employs the synthesis parameter, which is stored in the parameter memory 4, the frame time length, which is set by the frame time setter 5, and the waveform point number, which is stored in the waveform point number memory 6, to perform interpolation for the synthesis parameter. The parameter interpolation is performed in the same manner as at step S10 in Embodiment 1.

At step S212, the pitch scale interpolator 8 employs the pitch scale, which is stored in the parameter memory 4, the frame time length, which is set by the frame time setter 5, and the waveform point number, which is stored in the waveform point number memory 6 to interpolate the pitch scale. The pitch scale interpolation is performed in the same manner as at step S11 in Embodiment 1.

At step S213, a phase index is determined by $$i_p=I(s,\ \phi_p),$$

which is established by using pitch scale s and phase angle $\phi_p$ that are acquired by equation (4).

At step S214, the waveform generator 9 employs synthesis parameter p [m] ($0\leqq m<M$), which is obtained by equation (3), and pitch scale s, which is obtained by equation (4) to generate a pitch waveform. The waveform generator 9 reads, from the table, pitch waveform point number P (s, $i_p$), power normalization coefficient C (s), and waveform generation matrix WGM (s, $i_p$)=($c_{km}$ (s, $i_p$)) ($0 \leqq k < P$ (s, $i_p$), $0 \leqq m < M$), which correspond to pitch scale s, and generates a pitch waveform by the following expression:

$$w_p(k) = C(s) \sum_{m=0}^{M-1} c_{km}(s,i_p)p(m)(0 \leqq k < N(s,i_p)).$$

A speech waveform that is output as synthesized speech by the waveform generator 9 is defined as $$W(n)\ (0 \leqq n).$$

The pitch waveforms are linked in the same manner as in Embodiment 1. With the time length for the jth frame defined as $N_j$, $$W(n_w + k) = w_p(k)(i = 0, 0 \leqq k < P(s,i_p))$$

$$W\left(\sum_{j=0}^{i-1} N_j + n_w + k\right) = w_p(k)(i > 0, 0 \leqq k < P(s,i_p))$$

At step S215, the phase index is updated as described below:

$$i_p = (i_p + 1) \bmod n_p(s),$$

and the updated phase index is employed to update the phase angle as follows:

$$\phi_p = \phi(s, i_p).$$

At step S216, in the waveform point number memory 6, the waveform point number $n_w$ is updated with $$n_w = n_w 30\ P(s, i_p),$$

program control returns to step S210, and the processing is repeated.

When, at step S210, $n_2 \geqq N_i$, program control goes to step S217.

At step S217, the waveform point number $n_w$ is initialized as $$n_w = n_w - N_i.$$

At step S218, a check is performed to determine whether or not the process for all the frames has been completed. When the process has not yet been completed, program control goes to step S219.

At step S219, the control data (utterance speed, pitch of speech, etc.) that are input externally are stored in the control data memory 2. At step S220, parameter series counter i is updated as $$i = i + 1.$$

Program control then returns to step S207 and the processing is repeated.

When, at step S218, the process for all the frames has been completed, the processing is thereafter terminated.

(Embodiment 3)

In addition to the method for generating a pitch waveform described in Embodiment 1, generation of an unvoiced waveform will now be described in this embodiment.

Figure 14:
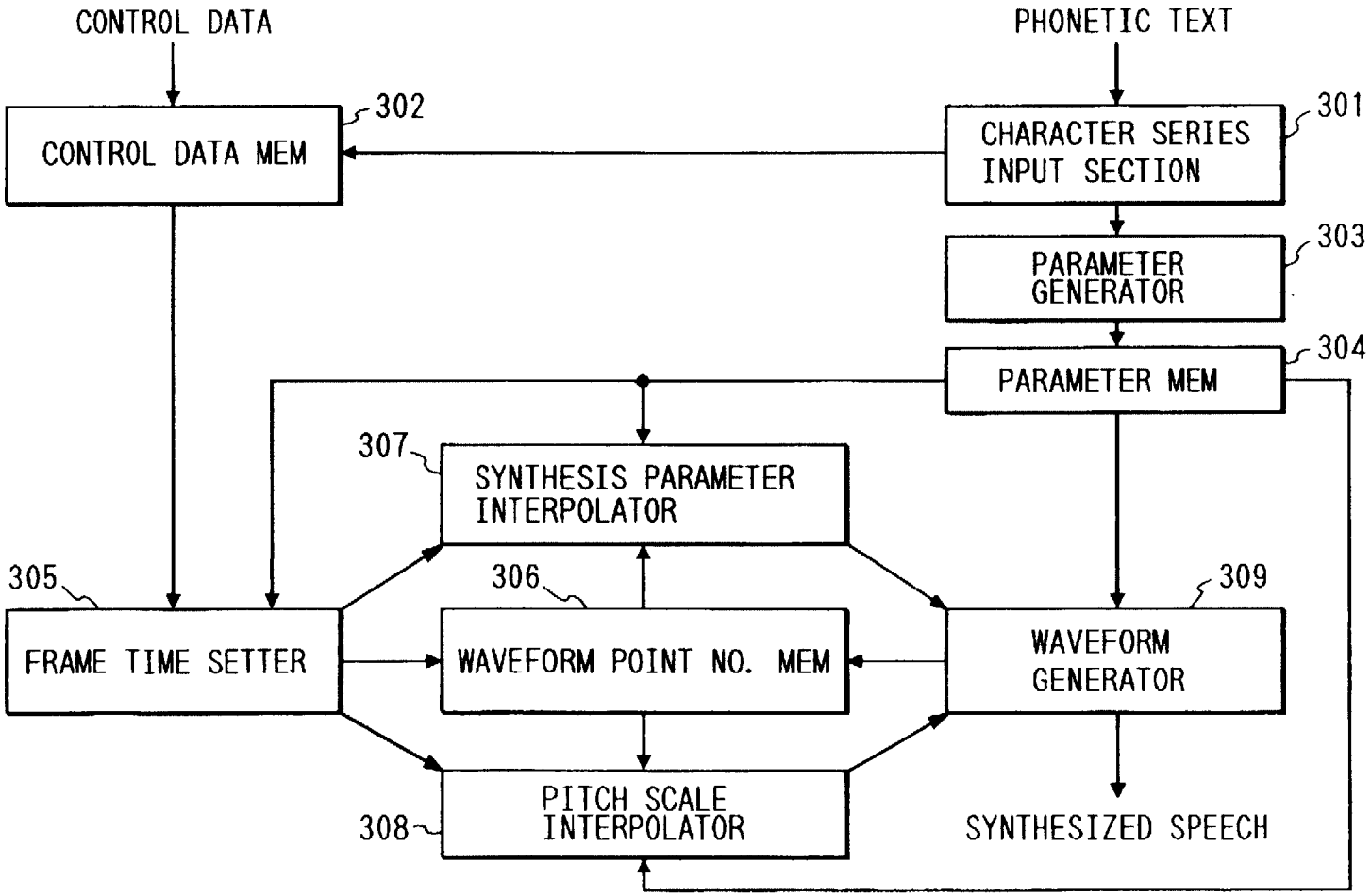
FIG. 14 is a block diagram illustrating the functional arrangement of a speech synthesis apparatus according to another embodiment.

FIG. 14 is a block diagram illustrating the functional arrangement of a speech synthesis apparatus in Embodiment 3. The individual functions are performed under the control of the CPU 103 in FIG. 25. A character series input section 301 inputs a character series of speech to be synthesized. When speech to be synthesized is, for example, "voice", a character series of such phonetic text as "OnSEI" is input. In addition to a phonetic text, the character series that is input by the character series input section 1 sometimes includes a character series that constitutes a control sequence for setting utterance speed and a speech pitch. The character series input section 301 determines whether or not the input character series is phonetic text or a control sequence. In a control data memory 302 is an internal register, where are stored a character series, which is determined as a control sequence by the character series input section 301 and forwarded thereto, and control data, such as utterance speed and speech pitch, which are input by a under interface. A parameter generator 303 reads, from the ROM 105, a parameter series that is stored in advance in consonance with a character series, which has been input and has been determined to be phonetic text by the character series input section 301, and generates a parameter series. Parameters for a frame that is to be processed are extracted from the parameter series that is generated by the parameter generator 303, and are stored in the internal register of a parameter memory 304. A frame time setter 305 employs control data that concern utterance speed, which is stored in the control data memory 302, and utterance speed coefficient K (parameter employed for determining a frame time length in consonance with utterance speed), which is stored in the parameter memory 304, and calculates time length $N_i$ for each frame. A waveform point number memory 306 has an internal register wherein is stored acquired waveform point number $n_w$ for each frame. A synthesis parameter interpolator 307 interpolates synthesis parameters that are stored in the parameter memory 304 by using frame time length $N_i$, which is set by the frame time length setter 305, and waveform point number $n_w$, which is stored in the waveform point number memory 306. A pitch scale interpolator 308 interpolates a pitch scale that is stored in the parameter memory 304 by using frame time length $n_i$, which is set by the frame time length setter 305, and waveform point number $n_w$, which is stored in the waveform point number memory 306. A waveform generator 309 generates pitch waveforms by using a synthesis parameter, which is obtained as a result of the interpolation by the synthesis parameter interpolator 307, and a pitch scale, which is obtained as a result of the interpolation by the pitch scale interpolator 308, and links together the pitch waveforms, so that synthesized speech is output. In addition, the waveform generator 309 generates unvoiced waveforms by employing a synthesis parameter that is output by the synthesis parameter interpolator 307, and links the unvoiced waveforms together to output synthesized speech.

The processing performed by the waveform generator 309 to generate a pitch waveform is the same as that performed by the waveform generator 9 in Embodiment 1.

In this embodiment, in addition to pitch waveform generation that is performed by the waveform generator 9, the generation of an unvoiced waveform will now be described.

Suppose that a synthesis parameter that is employed for generation of an unvoiced waveform is $$p(m)\ (0 \leqq m < M)$$

and a sampling frequency is $f_s$. A sampling period then is $$T_s = \frac{1}{f_s}.$$

A pitch frequency of a sine wave that is employed for the generation of an unvoiced waveform is denoted by f, which is set to a frequency that is lower than an audio frequency band.

The notation [x] represents an integer that is equal to or smaller than x.

The pitch period point number that corresponds to pitch frequency f is $$N_p(f) = \left[\frac{f_s}{f}\right].$$

An unvoiced waveform point number is defined as $$N_{uv} = N_p(f).$$

With $\theta_1$ as an angle for each point when the unvoiced waveform point number corresponds to angle $2\pi$, $$\theta = \frac{2\pi}{N_{uv}}.$$

The value of a spectral envelope that is integer times as large as the pitch frequency f is an expressed as follows:

$$e(1) = \sum_{m=0}^{M-1} p(m)\cos(ml\theta)(\leqq l \leqq [N_{uv}/2]).$$

The expanded unvoiced waveform is $$w_{uv}(k)\ (0 \leqq k < N_{uv}),$$

and a power normalization coefficient that corresponds to pitch frequency f is $$C(f).$$

When a pitch frequency with which C (f)=1.0 is established is $f_0$, the following equation provides C (f):

$$C(f) = \sqrt{\frac{f}{f_0}}.$$

A power normalization coefficient that is used for the generation of an unvoiced waveform is defined as $$C_{uv} = C(f).$$

Sine waves that are an integer times as large as a pitch frequency are superposed while their phases are shifted at random to provide an unvoiced waveform. A shift in phases is denoted by $\alpha_1$ ($1 \leqq 1 \leqq [N_{uv}/2]$). The expression $\alpha_1$ is set to a random value such that it satisfies $$-\pi \leqq \alpha_1 < \pi.$$

Then, unvoiced waveform $w_{uv}(k)$ ($0 \leqq k < N_{uv}$) can be generated as follows:

$$w_{uv}(k) = C_{uv} \sum_{l=1}^{[N_{uv}/2]} e(l)\sin(lk\theta + \alpha_1) \tag{7}$$

$$w_{uv}(k) = C_{uv} \sum_{l=1}^{[N_{uv}/2]} \sin(lk\theta + \alpha_1) \sum_{m=0}^{M-1} p(m)\cos(ml\theta)$$

$$w_{uv}(k) = C_{uv} \sum_{m=0}^{M-1} p(m) \sum_{l=1}^{[N_{uv}/2]} \sin(lk\theta + \alpha_1)\cos(ml\theta)$$

Instead of calculating equation (7), the speed of computation can be increased as follows. With an unvoiced waveform index as $$i_{uv}(0 \leqq i_{uv} < N_{uv}),$$

$$c(i_{uv}, m) = \sum_{l=1}^{[N_{uv}/2]} \sin(li_{uv}\theta + \alpha_1)\cos(ml\theta)(0 \leqq m < M)$$

is calculated and stored in the table. An unvoiced waveform generation matrix is defined as $$UVWGM(i_{uv}) = (c(_{uv}, m))\ (0 \leqq i_{uv} < N_{uv},\ 0 \leqq m < M).$$

In addition, pitch period point number $N_{uv}$ and power normalization coefficient $C_{uv}$ are stored in the table.

In the waveform generator 309, with an unvoiced waveform index that is stored in the internal register being denoted by $i_{uv}$, and synthesis parameter p (m) ($0 \leqq m < M$), which is output by the synthesis parameter interpolator 7, being employed as input data, unvoiced waveform generation matrix UVWGM ($i_{uv}$)=(c ($i_{uv}$, m)) is read from the table, and an unvoiced generator is generated for one point by equation $$w_{uv}(i_{uv}) = C_{uv} \sum_{m=0}^{M-1} c(i_{uv}, m)p(m).$$

After the unvoiced waveform has been generated, pitch period point number $N_{uv}$ is read from the table, and unvoiced waveform index $i_{uv}$ is updated as $$i_{uv} = (i_{uv} + 1) \bmod N_{uv}.$$

Waveform point number $n_w$ that is stored in the waveform point number memory 306 is also updated below $$n_w = n_w + 1.$$

Figure 15:
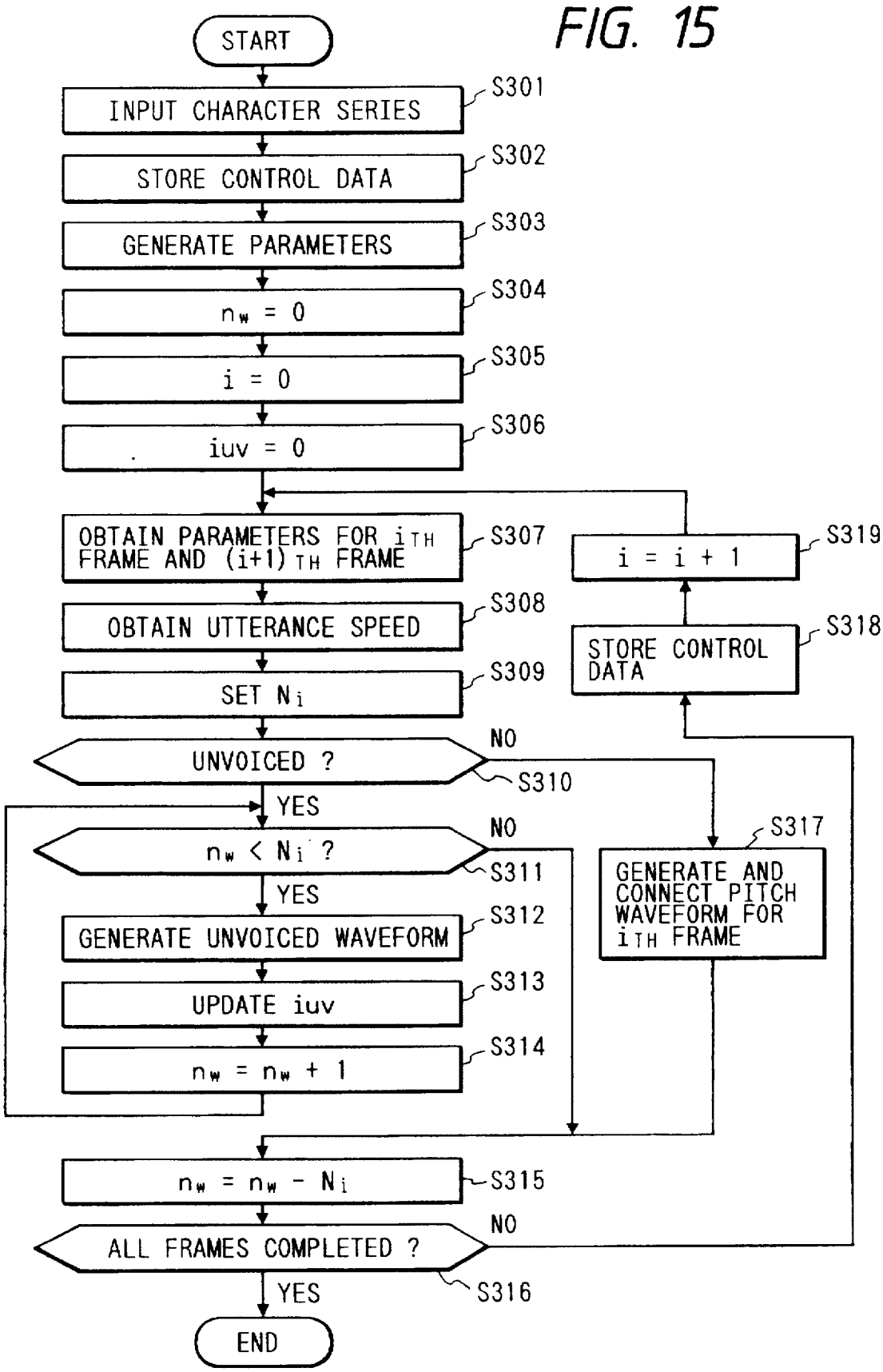
FIG. 15 is a flowchart showing a speech waveform generation process.

The above described process will now be described while referring to the flowchart in FIG. 15.

At step S301, phonetic text is input by the character series input section 301.

At step S302, control data (utterance speed, pitch of speech, etc.) that are externally input and control data for the input phonetic text are stored in the control data memory 302.

At step S303, the parameter generator 303 generates a parameter series with the phonetic text that has been input by the character series input section 301.

The data structure for one frame of parameters that are generated at step S303 is shown in FIG. 16.

At step S304, the internal register of the waveform point number memory 306 is set to 0. The waveform point number is represented by $n_w$ as follows:

$n_w=0.$

At step S305, parameter series counter i is initialized to 0.

At step S306, unvoiced waveform index $i_{uv}$ is initialized to 0.

At step S307, parameters for the ith frame and the (i+1)th frame are fetched from the parameter generator 303 into the parameter memory 304.

At step S308, utterance speed data are fetched from the control data memory 302 for use by the frame time setter 305.

At step S309, the frame time setter 305 employs utterance speed coefficients for the parameters, which have been fetched and stored in the parameter memory 304, and utterance speed data that have been fetched from the control data memory 302 to set frame time length Ni.

At step S310, voiced or unvoiced parameter information that is fetched and stored in the parameter memory 304 is employed to determine whether or not the parameter of the ith frame is for an unvoiced waveform.

If the parameter for that frame is for an unvoiced waveform, program control advances to step S311. If the parameter is for a voiced waveform, program control moves to step S317.

At step S311, a check is performed to determine whether or not waveform point number $n_w$ is smaller than frame time length Ni. When $n_w \geqq Ni$, program control advances to step S315. When $n_w < Ni$, program control moves to step S312 where the process is continued.

At step S312, the waveform generator 9 employs a synthesis parameter for the ith frame, $p_i$ [m] ($0 \leqq m < M$), which is input by the synthesis parameter interpolator 307, to generate an unvoiced waveform. The waveform generator 9 reads power normalization coefficient C (s) from the table, and also reads from the table waveform generation matrix UVWGM ($i_{uv}$)=(c ($i_{uv}$, m)) ($0 \leqq m < M$), which corresponds to unvoiced waveform index $i_{uv}$. Then, an unvoiced waveform is generated with the following equation:

$$w_{uv}(i_{uv}) = C_{uv} \sum_{m=0}^{M-1} c(i_{uv},m)p(m).$$

A speech waveform that is output as synthesized speech by the waveform generator 309 is defined as $$W(n)\ (0 \leqq n).$$

The unvoiced waveforms are linked with the time length for the jth frame being defined as $N_j$ from the equation $$W(n_w + 1) = w_{uv}(i_{uv})(i = 0)$$

$$W\left(\sum_{j=0}^{i-1} N_j + n_w + 1\right) = w_{uv}(i_{uv})(i > 0).$$

At step S313, unvoiced waveform point number $N_{uv}$ is read from the table, and an unvoiced waveform index is updated as described below:

$$i_{uv}=(i_{uv}+1) \bmod N_{uv}.$$

At step S314, in the waveform point number memory 306, the waveform point number $n_w$ is updated by $$n_w=n_w+1,$$

program control returns to step S311, and the processing is repeated.

When, at step S310, information indicates an unvoiced parameter, program control moves to step S317, where pitch waveforms for the ith frame are generated and are linked together. The processing at this step is the same as that which is performed at steps S9 through S13 in Embodiment 1.

When, at step S311, $n_w \geqq N_i$, program control goes to step S315, and the waveform point number $n_w$ is initialized as $$n_w=n_w-N_i.$$

At step S316, a check is performed to determine whether or not the process for all the frames has been completed. When the process has not yet been completed, program control goes to step S318.

At step S318, the control data (utterance speed, pitch of speech, etc.) that are input externally are stored in the control data memory 302. At step S319, parameter series counter i is updated as $$i=i+1.$$

Program control then returns to step S307 and the processing is repeated.

When, at step S316, the process for all the frames has been completed, the processing is thereafter terminated.

(Embodiment 4)

In this embodiment, an explanation will be given for an example where processing can be performed at a sampling frequency that differs at the analyzing process and at the synthesizing process.

The structure and the functional arrangement of a speech synthesis apparatus according to Embodiment 4 are shown in the block diagrams in FIGS. 25 and 1, as for Embodiment 1.

The processing by the waveform generator 9 for the generation of a pitch waveform will be described.

Suppose that a synthesis parameter that is employed for generation of a pitch waveform is $$p(m)\ (0 \leqq m < M)$$

and a sampling frequency, for an impulse response waveform, that is a synthesis parameter, is defined as an analysis sampling frequency of $f_{s1}$. An analysis sampling period then is $$T_{s1} = \frac{1}{f_{s1}}.$$

When a pitch frequency of synthesized speech is f, a pitch period is $$T = \frac{1}{f},$$

and the analysis pitch period point number is $$N_{p1}(f)=f_{s1}T=\frac{T}{T_{s1}}=\frac{f_{s1}}{f}.$$

The expression [x] represents an integer that is equal to or smaller than x, and the analysis pitch period point is quantized so that it becomes $$N_{p1}(f)=[N_{p1}(f)].$$

When a sampling frequency for synthesized speech is denoted by a synthesis sampling frequency of $f_{s2}$, the synthesis pitch period point number is $$N_{p2}(f)=\frac{f_{s2}}{f},$$

which when quantized becomes $$N_{p2}(f)=\left[\frac{f_{s2}}{f}\right].$$

With $\theta_1$ as an angle for one point when the analysis pitch period point number corresponds to angle $2\pi$, $$\theta_1=\frac{2\pi}{N_{p1}(f)}.$$

The value of a spectral envelope that is integer times as large as the pitch frequency is expressed as follows:

$$e(1)=\sum_{m=0}^{M-1}p(m)\cos(ml\theta_1)(1\leqq l\leqq[N_{p1}(f)/2]).$$

With $\theta_2$ as an angle for one point when the synthesis pitch period point number corresponds to $2\pi$, $$\theta_2=\frac{2\pi}{N_{p2}(f)}.$$

The pitch waveform is $$w(k)\ (0\leqq k<N_{p2}(f)),$$

and a power normalization coefficient that corresponds to pitch frequency f is $$C(f).$$

When a pitch frequency with which C(f)=1.0 is established is $f_0$, the following equation provides C(f):

$$C(f)=\sqrt{\frac{f}{f_0}}.$$

Sine waves that are an integer times as large as a itch frequency are superposed, and pitch waveform w (k) ($0\leqq k<N_{p2}$ (f)) can be generated by using the following expression:

$$w(k)=C(f)\sum_{l=1}^{[N_{p1}(f)/2]}e(l)\sin(lkn_p(f)\theta_2) \tag{8}$$

$$w(k)=C(f)\sum_{l=1}^{[N_{p1}(f)/2]}\sin(lkn_p(f)\theta_2)\sum_{m=0}^{M-1}p(m)\cos(ml\theta_1)$$

$$w(k)=C(f)\sum_{m=0}^{M-1}p(m)\sum_{l=1}^{[N_{p1}(f)/2]}\sin(lkn_p(f)\theta_2)\cos(ml\theta_1)$$

Or, the sine waves are superposed with half of a phase of the pitch period being shifted, and pitch waveform w (k) ($0\leqq k<N_{p2}$ (f)) can be generated by the following expression:

$$w(k)=C(f)\sum_{l=1}^{[N_{p1}(f)/2]}e(l)\sin(l(k\theta_2+\pi)) \tag{9}$$

$$w(k)=C(f)\sum_{l=1}^{[N_{p1}(f)/2]}\sin(l(k\theta_2+\pi))\sum_{m=0}^{M-1}p(m)\cos(ml\theta_1)$$

$$w(k)=C(f)\sum_{m=0}^{M-1}p(m)\sum_{l=1}^{[N_{p2}(f)/2]}\sin(l(k\theta_2+\pi))\cos(ml\theta_1)$$

The pitch scale is employed as a scale for representing the tone of speech. Instead of calculating expressions (8) and (9), the speed of calculation can be increased as follows. When $N_{p1}$ (s) is a phase number that corresponds to pitch scale $s\in S$ (S denotes a set of pitch scales) and $N_{p2}$ (s) is a synthesis pitch period point number, with the following equations $$\theta_1=\frac{2\pi}{N_{p1}(s)}$$

$$\theta_2=\frac{2\pi}{N_{p2}(s)},$$

for equation (8), $$c_{km}(s)=\sum_{l=1}^{[N_{p1}(s)/2]}\sin(lk\theta_2)\cos(ml\theta_1)$$

is calculated, and for equation (9), $$c_{km}(s)=\sum_{l=1}^{[N_{p1}(s)/2]}\sin(l(k\theta_2+\pi))\cos(ml\theta_1)$$

is calculated, and these results are stored in the table. A pitch scale generation matrix is defined as $$WGM(s)=(c_{km}(s))\ (0\leqq k<N_{p2}(s),\ 0\leqq m<M).$$

In addition, synthesis pitch period point number $N_{p2}$ (s) and power normalization coefficient C(s), both of which correspond to pitch scale s, are stored in the table.

In the waveform generator 9, synthesis parameter p (m) ($0\leqq m<M$), which is output by the synthesis parameter interpolator 7, and pitch scale s, which is output by the pitch scale interpolator 8, are employed as input data, and synthesis pitch waveform point number $N_{p2}$ (s), power normalization coefficient C (s), and waveform generation matrix WGM (s)=($c_{km}$ (s)) are read from the table. A pitch waveform is then generated by equation $$w(k) = C(s) \sum_{m=0}^{M-1} c_{km}(s)p(m)(0 \leqq k < N_{p2}(s)).$$

The above described process will now be described while referring to the flowchart in FIG. 7.

The procedures performed at steps S1 through S11 in this embodiment are the same as those performed in Embodiment 1.

The process at step S12 for pitch waveform generation in this embodiment will now be described. The waveform generator 9 employs synthesis parameter p [m] ($0 \leqq m < M$), which is obtained by using equation (3), and pitch scale s, which is obtained by using equation (4), to generate a pitch waveform. The waveform generator 9 reads, from the table, synthesis pitch waveform point number $N_{p2}$ (s), power normalization coefficient C (s), and waveform generation matrix WGM $(s)=(c_{km}(s))$ ($0 \leqq k < N_{p2}(s)$, $0 \leqq m < M$), all of which correspond to pitch scale s, and generates a pitch waveform by using the following equation:

$$w(k) = C(s) \sum_{m=0}^{M-1} c_{km}(s)p(m)(0 \leqq k < N_{p2}(s)).$$

A speech waveform that is output as synthesized speech by the waveform generator 9 is defined as $$W(n)\ (0 \leqq n).$$

The pitch waveforms are linked together with the time length for the jth frame, which is defined as $N_j$, so that $$W(n_w + k) = w(k)\ (i = 0,\ 0 \leqq k < N_{p2}(s))$$

$$W\left(\sum_{j=0}^{i-1} N_j + n_w + k\right) = w(k)\ (i > 0,\ 0 \leqq k < N_{p2}(s)).$$

At step S13, in the waveform point number memory 6, the waveform point number $n_w$ is updated to $$n_w = n_w + N_{p2}(s).$$

The procedures performed at steps S14 through S17 in this embodiment are the same as those performed in Embodiment 1.

(Embodiment 5)

In this embodiment, an example is discussed where a pitch waveform is generated by a power spectrum envelope to enable parameter operations, within a frequency range, that employs the power spectral envelope.

As they are for Embodiment 1, the structure and the functional arrangement of a speech synthesis apparatus in Embodiment 5 are shown in FIGS. 25 and 1.

Processing of the waveform generator 9 for generating a pitch waveform will now be described.

Figure 17:
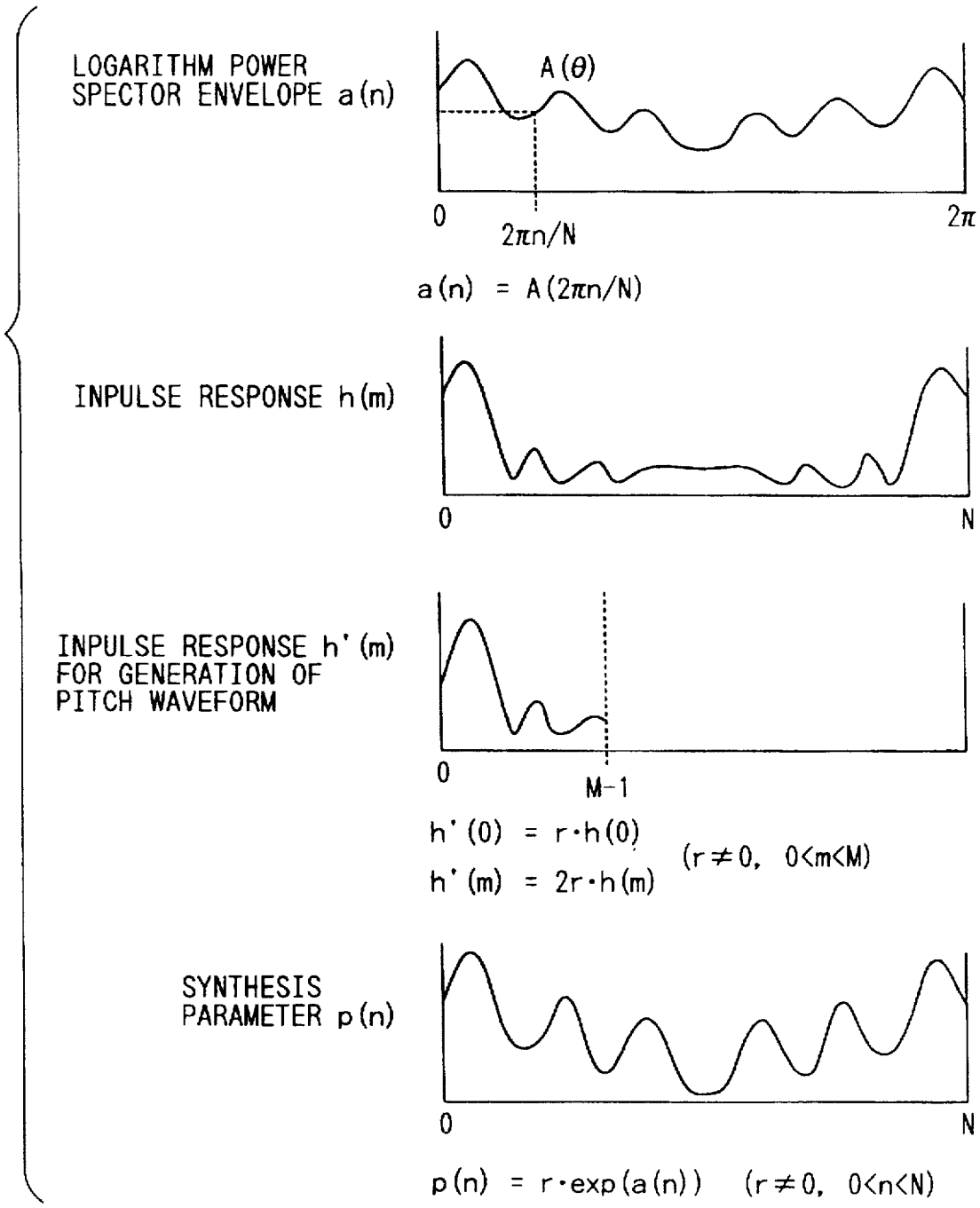
FIG. 17 is an explanatory diagram for a synthesis parameter.

A synthesis parameter that is employed for the generation of a pitch waveform will be explained. In FIG. 17, with the power of the Fourier transform being denoted by N, and the power of a synthesis parameter being denoted by M, N and M satisfy $N \geqq 2M$. Suppose that a logarithm power spectrum envelope for speech is $$a(n) = A\left(\frac{2\pi n}{N}\right)\ (0 \leqq n < N).$$

The logarithm power spectrum envelope is substituted into an exponentional function to return the envelope to a linear form, and a reverse Fourier transform is performed on the resultant envelope. The acquired impulse response is $$h(m) = \frac{1}{N} \sum_{n=0}^{N-1} \exp(a(n))\cos\left(\frac{2\pi nm}{N}\right)\ (0 \leqq m < N).$$

Impulse response waveform $$h'(m)\ (0 \leqq m < M),$$

which is employed for the generation of a pitch waveform, is acquired by relatively doubling the ratio of a value of the power of 0 of the impulse response and a value of the power of 1 and the following number of the impulse response. In other words, with $r \neq 0$, $$h'(0) = rh(0)$$

$$h'(m) = 2rh(m)\ (1 \leqq m < M).$$

When a synthesis parameter is defined as $$p(n) = r \cdot \exp(a(n))\ (0 \leqq n < N),$$

$$h'(m) = \frac{1}{N} \sum_{n=0}^{N-1} p(n)\ (m = 0)$$

$$h'(m) = \frac{2}{N} \sum_{m=0}^{N-1} p(n)\cos\left(\frac{2\pi nm}{N}\right)\ (1 \leqq m < M).$$

When the following equation is established $$b_{nm} = \begin{cases} \frac{1}{N} & (m = 0,\ 0 \leqq n < N) \\ \frac{2}{N}\cos\left(\frac{2\pi nm}{N}\right) & (1 \leqq m < M,\ 0 \leqq n < N), \end{cases}$$

then, $$h'(m) = \sum_{n=0}^{N-1} b_{nm}p(n)\ (0 \leqq m < M).$$

With a sampling frequency of $f_s$, a sampling period is $$T_s = \frac{1}{f_s}.$$

When a pitch frequency of synthesized speech is f, a pitch period is $$T = \frac{1}{f},$$

and the pitch period point number is $$N_p(f) = f_s T = \frac{T}{T_s} = \frac{f_s}{f}.$$

The expression [x] represents an integer that is equal to or smaller than x, and the pitch period point number, which is quantized by using an integer, is expressed as $$N_p(f)=[N_p(f)].$$

When the pitch period corresponds to angle $2\pi$, an angle for each point is represented by $\theta$, $$\theta=\frac{2\pi}{N_p(f)}.$$

The value of a spectral envelope that is integer times as large as the pitch frequency is expressed as follows:

$$e(l)=\sum_{m=0}^{M-1} h'(m)\cos(ml\theta)\ (1 \leqq l \leqq [N_p(f)/2])$$

$$e(l)=\sum_{m=0}^{M-1}\sum_{n=0}^{N-1} b_{mn}p(n)\cos(ml\theta)\ (1 \leqq l \leqq [N_p(f)/2])$$

$$e(l)=\sum_{n=0}^{N-1} p(n)\sum_{m=0}^{M-1} b_{mn}\cos(ml\theta)\ (1 \leqq l \leqq [N_p(f)/2])$$

A pitch waveform is $$w(k)\ (0 \leqq k \leqq N_p(f)),$$

and a power normalization coefficient that corresponds to pitch frequency f is $$C(f).$$

When a pitch frequency with which C (f)=1.0 is established is $f_0$, the following equation provides C(f):

$$C(f)=\sqrt{\frac{f}{f_0}}.$$

Sine waves that are integer times as large as a fundamental frequency are superposed, and pitch waveform w (k) ($0 \leqq k < N_p$ (f)) is generated as follows:

$$w(k)=C(f)\sum_{l=1}^{[N_p(f)/2]} e(l)\sin(lk\theta) \tag{10}$$

$$w(k)=C(f)\sum_{l=1}^{[N_p(f)/2]} \sin(lk\theta)\sum_{n=0}^{N-1} p(n)\sum_{m=0}^{N-1}\cos(ml\theta)$$

$$w(k)=C(f)\sum_{n=0}^{N-1} p(n)\sum_{m=0}^{M-1} b_{mn}\sum_{l=1}^{[N_p(f)/2]}\sin(lk\theta)\cos(ml\theta)$$

Or, the sine waves are superposed with half of a phase of the pitch period being shifted, and pitch waveform w (k) ($0 \leqq k < N_p$ (f)) is generated as follows:

$$w(k)=C(f)\sum_{l=1}^{[N_p(f)/2]} e(l)\sin(l(k\theta+\pi)) \tag{11}$$

$$w(k)=C(f)\sum_{l=1}^{[N_p(f)/2]} \sin(l(k\theta+\pi))\sum_{n=0}^{N-1} p(n)\sum_{m=0}^{M-1} b_{mn}\cos(ml\theta)$$

$$w(k)=C(f)\sum_{n=0}^{N-1} p(n)\sum_{m=0}^{M-1} b_{mn}\sum_{l=1}^{[N_p(f)/2]}\sin(l(k\theta+\pi))\cos(ml\theta)$$

The pitch scale is employed as a scale for representing the tone of speech. Instead of calculating expressions (10) and (11), the speed of calculation can be increased as follows: with $N_p$ (s) as a pitch period point number that corresponds to pitch scale s, $$\theta=\frac{2\pi}{N_p(S)},$$

$$C_{kn}(S)=\sum_{m=0}^{M-1} b_{mn}\sum_{l=1}^{[N_p(S)/2]}\sin(lk\theta)\cos(ml\theta)$$

is calculated for expression (10), and $$C_{kn}(S)=\sum_{m=0}^{M-1} b_{mn}\sum_{l=1}^{[N_p(S)/2]}\sin(l(k\theta+\pi))\cos(ml\theta)$$

is calculated for expression (11), and these results are stored in a table. A waveform generation matrix is $$WGM(s)=(c_{kn}(s))\ (0 \leqq k < N_p(s),\ 0 \leqq n < N).$$

In addition, pitch period point number $N_p$ (s) and power normalization coefficient C (s) that correspond to pitch scale s are stored in a table.

Figure 18:
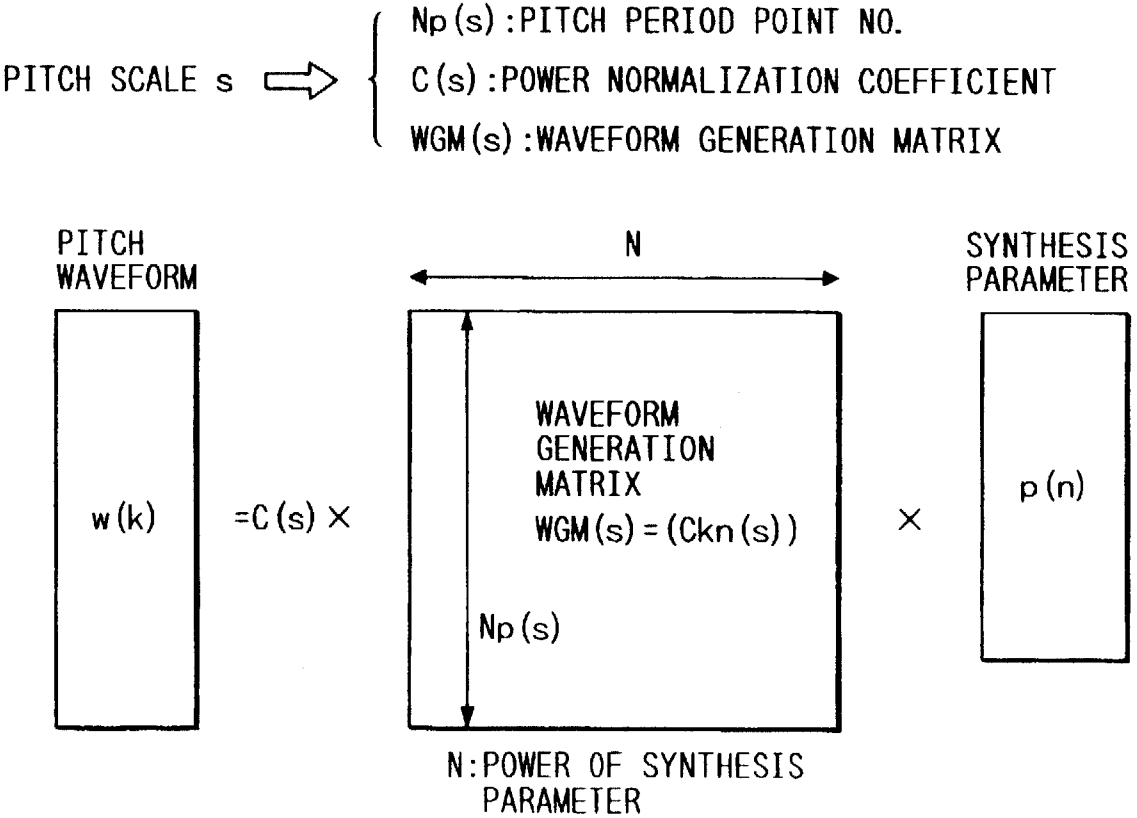
FIG. 18 is an explanatory diagram for generation of a pitch waveform.

By employing, as input data, the synthesis parameter p (n) ($0 \leqq n < N$), which is output by the synthesis parameter interpolator 7, and pitch scale s, which is output by the pitch scale interpolator 8, from the table the waveform generator 9 reads pitch period point number $N_p$ (s), power normalization coefficient C (s), and waveform generation matrix WGM (s)=($c_{kn}$ (s)), and generates a pitch waveform (FIG. 18) by using the following equation:

$$w(k)=C(s)\sum_{n=0}^{N-1} c_{kn}(s)p(n)\ (0 \leqq k < N_p(s)).$$

The above described process will now be described while referring to the flowchart in FIG. 7.

The procedures performed at steps S1, S2, and S3 are the same as those that are performed in Embodiment 1.

The data structure of one frame of parameters that is generated at step S3 is shown in FIG. 19.

The procedures at steps S4 through S9 are the same as those in Embodiment 1.

Figure 20:
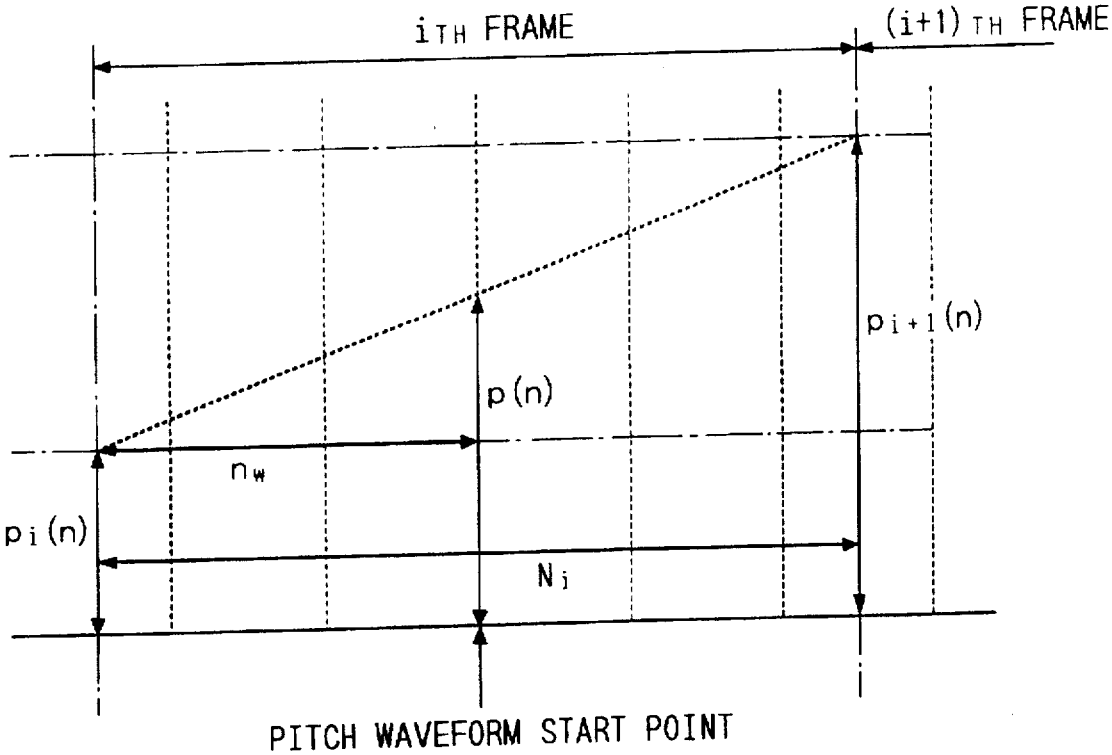
FIG. 20 is an explanatory diagram for interpolation of synthesis parameters.

At step S10, the synthesis parameter interpolator 7 employs the synthesis parameter, which is stored in the parameter memory 4, the frame time length, which is set by the frame time setter 5, and the waveform point number, which is stored in the waveform point number memory 6, to perform interpolation for the synthesis parameter. FIG. 20 is an explanatory diagram for the interpolation of the synthesis parameter. A synthesis parameter for the ith frame is denoted by pi [n] ($0 \leqq n < N$), a synthesis parameter for the (i+1)th frame is denoted by $p_{1+1}$ [n] ($0 \leqq n < N$), and the time length for the ith frame is denoted by $N_p$ point. A difference $\Delta_p$ [n] ($0 \leqq n < N$) of a synthesis parameter for each point is $$\Delta_p[n]=\frac{p_{i+1}[n]-p_i[n]}{N_i}.$$

Then, synthesis parameter p [n] ($0 \leqq n < N$) is updated each time a pitch waveform is generated. The process $$p[n]=p_i[n]+n_w\Delta_p[n]$$

performed at the starting point for a pitch waveform.

The procedure at step S11 is the same as that in embodiment 1.

At step S12, the waveform generator 9 employs synthesis parameter p [n] ($0 \leqq n < N$), which is obtained from equation (12), and pitch scale s, which is obtained from equation (4), to generate a pitch waveform. The waveform generator 9 reads, from the table, pitch period point number $N_p$ (s), power normalization coefficient C (s), and waveform generation matrix WGM (s)=($c_{kn}$ (s)) ($0 \leqq k < N_p$ (s), $0 \leqq n < N$), which correspond to pitch scale s, and generates a pitch waveform by using the following expression:

$$w(k) = C(s) \sum_{n=0}^{N-1} c_{kn}(s) p(n) (0 \leqq k < N_p(s)).$$

FIG. 11 is an explanatory diagram for the linking of generated pitch waveforms. A speech waveform that is output as synthesized speech by the waveform generator 9 is represented as $$W(n)\ (0 \leqq n).$$

The pitch waveforms are linked by the following equations:

$$W(n_w + k) = w(k)(i = 0, 0 \leqq k < N_p(s))$$

$$W\left(\sum_{j=0}^{i-1} N_j + n_w + k\right) = w(k)(i > 0, 0 \leqq k < N_p(s)).$$

The procedures performed at steps S13 through S17 are the same as those performed Embodiment 1.

(Embodiment 6)

In this embodiment, an example where a function that determines a frequency response is employed to transform a spectral envelope will be described.

As they are for Embodiment 1, the structure and the functional arrangement of a speech synthesis apparatus in Embodiment 6 are shown in the block diagrams in FIGS. 25 and 1.

The pitch waveform generation performed by the waveform generator 9 will now be explained.

A synthesis parameter that is employed for the generation of a pitch waveform is defined as $$p(m)\ (0 \leqq m < M).$$

With a sampling frequency of $f_s$, a sampling period is $$T_s = \frac{1}{f_s}.$$

When a pitch frequency of synthesized speech is f, a pitch period is $$T = \frac{1}{f},$$

and the pitch period point number is $$N_p(f) = f_s T = \frac{T}{T_s} = \frac{f_s}{f}.$$

The notation [x] represents an integer that is equal to or smaller than x, and the pitch period point number, which is quantized by using an integer, is expressed as $$N_p(f) = [N_p(f)].$$

When the pitch period corresponds to angle $2\pi$, an angle for each point is represented by $\theta$, $$\theta = \frac{2\pi}{N_p(f)}.$$

The value of a spectral envelope that is integer times as large as the pitch frequency is an expressed as follows:

$$e(l) = \sum_{m=0}^{M-1} p(m) \cos(ml\theta) (1 \leqq l \leqq [N_p(f)/2]).$$

A frequency response function that is employed for the operation of a spectral envelope is represented as $$r(x)\ (0 \leqq x \leqq f_s/2).$$

Figure 21:
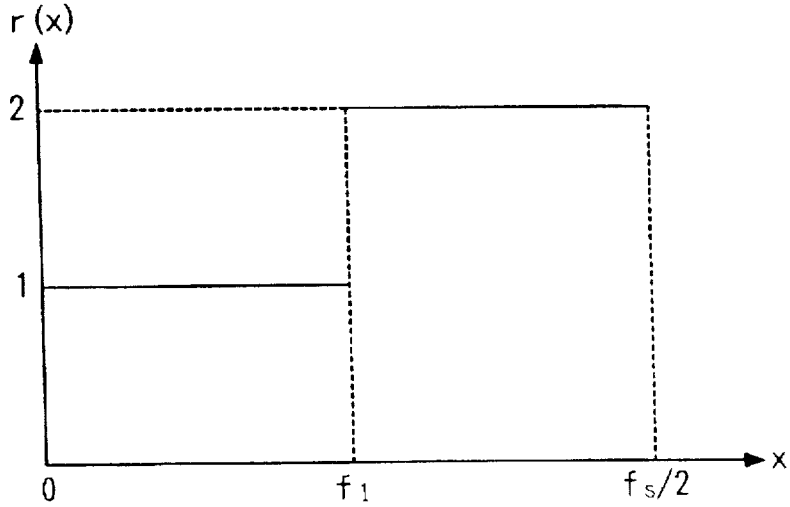
FIG. 21 is an explanatory diagram for a mathematical function of a frequency response.

In an example in FIG. 21, the amplitude of a high frequency that is equal to or greater than $f_1$ is increased twice as large. By changing r (x), the spectral envelope can be operated. This function is employed to transform the spectral envelope value that is an integer times a pitch frequency as follows $$r(lf)e(l) = r(lf) \sum_{m=0}^{M-1} p(m) \cos(ml\theta) (1 \leqq l \leqq [N_p(f)/2]).$$

A pitch waveform is $$w(k)\ (0 \leqq k \leqq N_p(f)),$$

and a power normalization coefficient that corresponds to pitch frequency f is $$C(f).$$

When a pitch frequency with which C (f)=1.0 is established is $f_0$, the following equation provides C(f):

$$C(f) = \sqrt{\frac{f}{f_0}}.$$

Sine waves that are an integer times as large as a fundamental frequency are superposed, and pitch waveform w (k) ($0 \leqq k < N_p$ (f)) can be generated by using the following expression:

$$w(k) = C(f) \sum_{l=1}^{[N_p(f)/2]} r(lf) e(l) \sin(lk\theta) \tag{13}$$

$$w(k) = c(f) \sum_{l=1}^{[N_p(f)/2]} \sin(lk\theta) r(lf) \sum_{m=0}^{M-1} p(m) \cos(ml\theta)$$

$$w(k) = c(f) \sum_{m=0}^{M-1} p(m) \sum_{l=1}^{[N_p(f)/2]} r(lf) \sin(lk\theta) \cos(ml\theta).$$

Or, the sine waves are superposed with half a phase of the pitch period being shifted, and pitch waveform w (k) ($0 \leqq k < N_p$ (f)) can be generated by the following expression:

$$w(k) = C(f) \sum_{l=1}^{[N_p(f)/2]} r(lf)e(l)\sin(l(k\theta + \pi)) \quad (14)$$

$$w(k) = C(f) \sum_{l=1}^{[N_p(f)/2]} \sin(l(k\theta + \pi))r(lf) \sum_{m=0}^{M-1} p(m)\cos(ml\theta)$$

$$w(k) = C(f) \sum_{m=0}^{M-1} p(m) \sum_{l=1}^{[N_p(f)/2]} r(lf)\sin(l(k\theta + \pi))\cos(ml\theta).$$

The pitch scale is employed as a scale for representing the tone of speech. Instead of calculating expressions (13) and (14), the speed of calculation can be increased as follows: with $N_p$ as a pitch period point number that corresponds to pitch scale s, $$\theta = \frac{2\pi}{N_p(S)} .$$

Further, a frequency response function is represented as $$r(x)(0 \leqq x \leqq f_s/2).$$

$$c_{km}(S) = \sum_{l=1}^{[N_p(S)/2]} r(lf)\sin(lk\theta)\cos(ml\theta)$$

is calculated for expression (13), and $$c_{km}(S) = \sum_{l=1}^{[N_p(S)/2]} r(lf)\sin(l(k\theta + \pi))\cos(ml\theta)$$

is calculated for expression (14), and these results are stored in a table. A waveform generation matrix is $$WGM(s)=(c_{km}(s)) \ (0 \leqq k < N_p(s),\ 0 \leqq m < M).$$

In addition, pitch period point number $N_p$ (s) and power normalization coefficient C (s) that correspond to pitch scale s are stored in a table.

By employing, as input data, the synthesis parameter p (m) ($0 \leqq m < M$), which is output by the synthesis parameter interpolator 7, and pitch scale s, which is output by the pitch scale interpolator 8, from the table the waveform generator 9 reads pitch period point number $N_p$ (s), power normalization coefficient C (s), and waveform generation matrix WGM (s)=($c_{km}$ (s)), and generates a pitch waveform (FIG. 6) by using the following equation:

$$w(k) = C(s) \sum_{m=0}^{M-1} c_{km}(s)p(m)(0 \leqq k < N_p(s)).$$

The above described process will now be explained while referring to the flowchart in FIG. 7.

The procedures performed at steps S1 through S11 are the same as those performed in Embodiment 1.

At step S12, the waveform generator 9 employs synthesis parameter p [m] ($0 \leqq m < M$), which is obtained from equation (3), and pitch scale s, which is obtained from equation (4), to generate a pitch waveform. The waveform generator 9 reads, from the table, pitch period point number $N_p$ (s), power normalization coefficient C (s), and waveform generation matrix WGM (s)=($c_{km}$ (s)) ($0 \leqq k < N_p$ (s), $0 \leqq m < M$), which correspond to pitch scale s, and generates a pitch waveform with the following expression:

$$w(k) = C(s) \sum_{m=0}^{M-1} c_{km}(s)p(m)(0 \leqq k < N_p(s)).$$

FIG. 11 is an explanatory diagram for the linking of generated pitch waveforms. A speech waveform that is output as synthesized speech by the waveform generator 9 is represented as $$W(n)\ (0 \leqq n).$$

The pitch waveforms are linked by the following equations:

$$W(n_w + k) = w(k)(i = 0, 0 \leqq k < N_p(s))$$

$$W\left(\sum_{j=0}^{i-1} N_j + n_w + k\right) = w(k)(i > 0, 0 \leqq k < N_p(s)).$$

The procedures performed at steps S13 through S17 are the same as those performed in Embodiment 1.

(Embodiment 7)

In this embodiment, instead of a sine function used in Embodiment 1, an example where a cosine function is employed will be described.

As they are for Embodiment 1, the structure and the functional arrangement of a speech synthesis apparatus in Embodiment 7 are shown in the block diagrams in FIGS. 25 and 1.

The pitch waveform generation performed by the waveform generator 9 will now be explained.

A synthesis parameter that is employed for the generation of a pitch waveform is defined as $$p(m)\ (0 \leqq m < M).$$

With a sampling frequency of $f_s$, a sampling period is $$T_s = \frac{1}{f_s} .$$

When a pitch frequency of synthesized speech is f, a pitch period is $$T = \frac{1}{f} ,$$

and the pitch period point number is $$N_p(f) = f_s T = \frac{T}{T_s} = \frac{f_s}{f} .$$

The notation [x] represents an integer that is equal to or smaller than x, and the pitch period point number, which is quantized by using an integer, is expressed as $$N_p(f) = [N_p(f)].$$

When the pitch period corresponds to angle $2\pi$, an angle for each point is represented by $\theta$, $$\theta = \frac{2\pi}{N_p(f)}.$$

The value of a spectral envelope that is an integer times as large as the pitch frequency is expressed as follows (FIG. 3):

$$e(l) = \sum_{m=0}^{M-1} p(m)\cos(ml\theta)(1 \leqq l \leqq [N_p(f)/2]).$$

A pitch waveform is $$w(k)\ (0 \leqq k < N_p(f)),$$

and a power normalization coefficient that corresponds to pitch frequency f is $$C(f).$$

When a pitch frequency with which C (f)=1.0 is established is $f_0$, the following equation provides C(f):

$$C(f) = \sqrt{\frac{f}{f_0}}.$$

When cosine waves that are an integer times as large as a fundamental frequency are superposed, $$w(k) = C(f) \sum_{l=1}^{[N_p(f)/2]} e(l)\cos(lk\theta) \tag{15}$$

$$w(k) = C(f) \sum_{l=1}^{[N_p(f)/2]} \cos(lk\theta) \sum_{m=0}^{M-1} p(m)\cos(ml\theta)$$

$$w(k) = C(f) \sum_{m=0}^{M-1} p(m) \sum_{l=1}^{[N_p(f)/2]} \cos(lk\theta)\cos(ml\theta).$$

Further, when a pitch frequency for the next pitch waveform is denoted by f', a value of the power of 0 for the next pitch waveform is $$w'(0) = C(f') \sum_{m=0}^{M-1} p(m) \sum_{l=1}^{[N_p(f)/2]} \cos(ml\theta).$$

Figure 22:
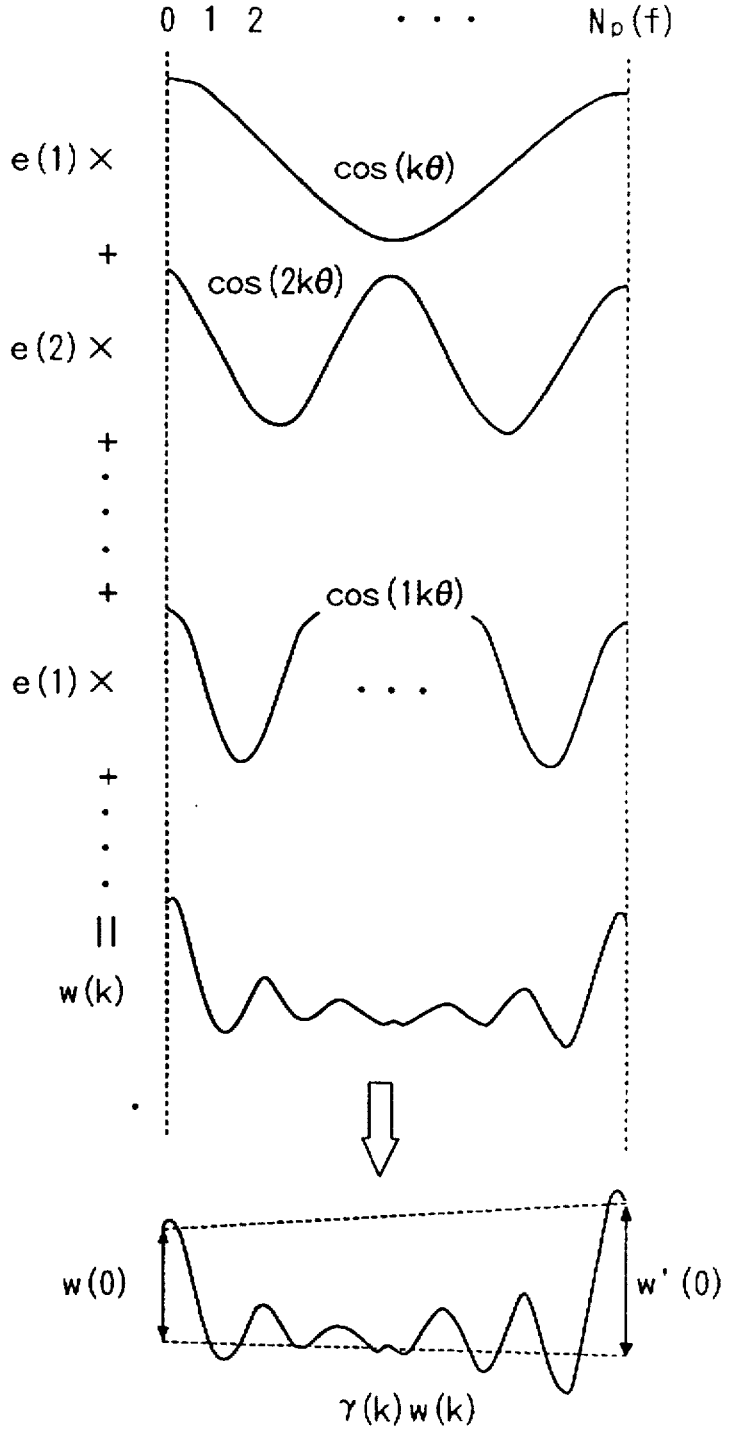
FIG. 22 is an explanatory diagram for the superposition of cosine waves.

Therefore, with $$\gamma_0 = \frac{w'(0)}{w(0)}$$

$$\gamma(k) = 1 + \frac{\gamma_0 - 1}{N_p(f)} \cdot k(0 \leqq k < N_p(f)),$$

pitch waveform w (k) ($0 \leqq k < N_p$ (f)) is generated from expression (FIG. 22)

$$w(k) = \gamma(k)w(k).$$

Figure 23:
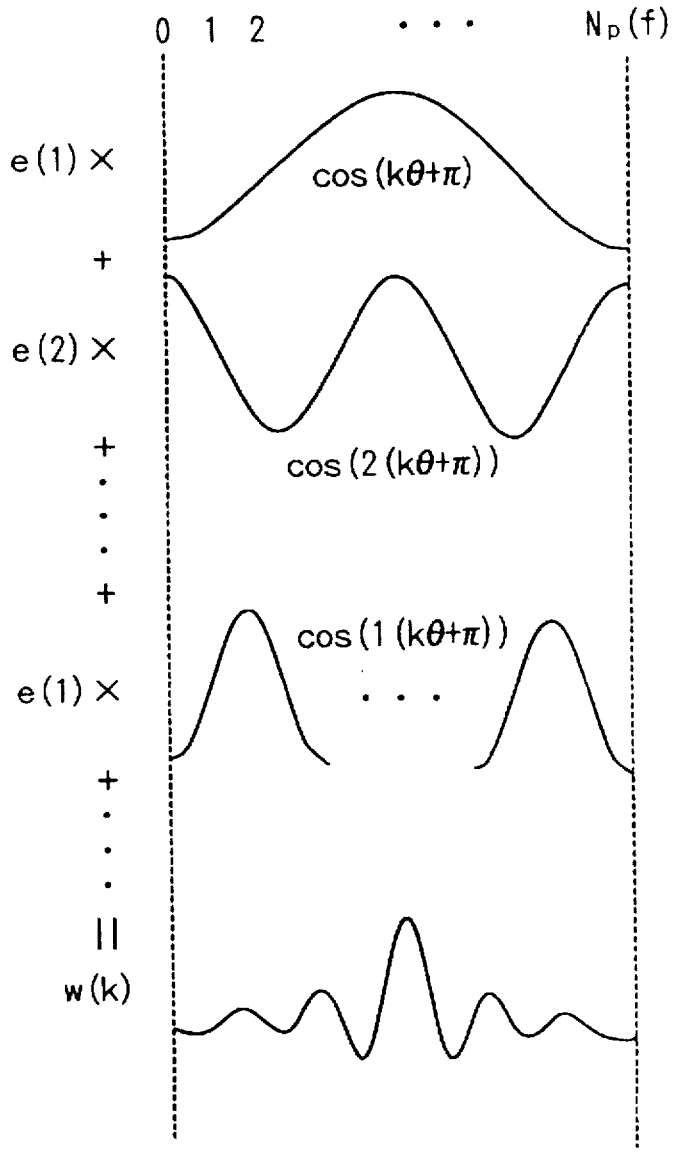
FIG. 23 is an explanatory diagram for the superposition of cosine waves.

Or, sine waves are superposed with half a phase of the pitch period being shifted, and pitch waveform w (k) ($0 \leqq k < N_p$ (f)) can be generated by the following expression (FIG. 23):

$$w(k) = C(f) \sum_{l=1}^{[N_p(f)/2]} e(l)\cos(l(k\theta + \pi)) \tag{16}$$

$$w(k) = C(f) \sum_{l=1}^{[N_p(f)/2]} \cos(l(k\theta + \pi)) \sum_{m=0}^{M-1} p(m)\cos(ml\theta)$$

$$w(k) = C(f) \sum_{m=0}^{M-1} p(m) \sum_{l=1}^{[N_p(f)/2]} \cos(l(k\theta + \pi))\cos(ml\theta).$$

The pitch scale is employed as a scale for representing the tone of speech. Instead of calculating expressions (15) and (16), the speed of calculation can be increased as follows: with $N_p$ as a pitch period point number that corresponds to pitch scale s, $$\theta = \frac{2\pi}{N_p(S)}. \tag{17}$$

$$c_{km}(S) = \sum_{l=1}^{[N_p(S)/2]} \cos(lk\theta)\cos(ml\theta)$$

is calculated for expression (15), and $$c_{km}(S) = \sum_{l=1}^{[N_p(S)/2]} \cos(l(k\theta + \pi))\cos(ml\theta)$$

is calculated for expression (14), and these results are stored in a table. A waveform generation matrix is $$WGM(s) = (c_{km}(s))\ (0 \leqq k < N_p(s),\ 0 \leqq m < M).$$

In addition, pitch period point number $N_p$ (s) and power normalization coefficient C (s) that correspond to pitch scale s are stored in a table.

By employing, as input data, the synthesis parameter p (m) ($0 \leqq m < M$), which is output by the synthesis parameter interpolator 7, and pitch scale s, which is output by the pitch scale interpolator 8, from the table the waveform generator 9 reads pitch period point number $N_p$ (s), power normalization coefficient C (s), and waveform generation matrix WGM (s)=($c_{km}$ (s)), and generates a pitch waveform (FIG. 6) by using the following equation:

$$w(k) = C(s) \sum_{m=0}^{M-1} c_{km}(s)p(m)(0 \leqq k < N_p(s)).$$

In addition, for calculation of a waveform generation matrix by using expression (17), with a pitch scale for the next pitch waveform being s', $$w'(0) = C(S') \sum_{m=0}^{M-1} p(m) \sum_{l=1}^{[N_p(s')/2]} \cos(ml\theta)$$

$$\gamma_0 = \frac{w'(0)}{w(0)}$$

$$\gamma(k) = 1 + \frac{\gamma_0 - 1}{N_p(s)} \cdot k(0 \leqq k < N_p(s))$$

is calculated and $$w(k)\gamma(k)w(k)$$

is defined as a pitch waveform.

The above described process will now be explained while referring to the flowchart in FIG. 7.

The procedures performed at steps S1 through S11 are the same as those performed in Embodiment 1.

At step S12, the waveform generator 9 employs synthesis parameter p [m] ($0 \leqq m < M$), which is obtained from equation (3), and pitch scale s, which is obtained from equation (4), to generate a pitch waveform. The waveform generator 9 reads, from the table, pitch period point number $N_p$ (s), power normalization coefficient C (s), and waveform generation matrix WGM (s)=($c_{km}$(s)) ($0 \leqq k < N_p$ (s), $0 \leqq m < M$), which correspond to pitch scale s, and generates a pitch waveform with the following expression:

$$w(k) = C(s) \sum_{m=0}^{M-1} c_{km}(s) p(m) (0 \leqq k < N_p(s)).$$

In addition, when a waveform generation matrix is calculated from expression (17), difference $\Delta_s$ of a pitch scale for one point is read from the pitch scale interpolator 8, and a pitch scale for the next pitch waveform is acquired by the following expression:

$$s' = s + N_p(s)\Delta_s.$$

$$w'(0) = C(S') \sum_{m=0}^{M-1} p(m) \sum_{l=1}^{[N_p(s')/2]} \cos(ml\theta)$$

$$\gamma_0 = \frac{w'(0)}{w(0)}$$

$$\gamma(k) = 1 + \frac{\gamma_0 - 1}{N_p(s)} \cdot k (0 \leqq k < N_p(s))$$

is then calculated with using s', and $$w(k)\gamma(k)w(k)$$

is defined as a pitch waveform.

FIG. 11 is an explanatory diagram for the linking of generated pitch waveforms. A speech waveform that is output as synthesized speech by the waveform generator 9 is represented as $$W(n) (0 \leqq n).$$

With the frame time length of the jth frame being $N_j$, the pitch waveforms are linked by the following equations:

$$W(n_w + k) = w(k)(i = 0, 0 \leqq k < N_p(s))$$

$$W\left(\sum_{j=0}^{i-1} N_j + n_w + k\right) = w(k)(i > 0, 0 \leqq k < N_p(s)).$$

The procedures performed at steps S13 through S17 are the same as those performed in Embodiment 1.

(Embodiment 8)

In this embodiment, an explanation will be given for an example where a pitch waveform of half a period is used for one period by employing pitch waveform symmetry.

As they are for Embodiment 1, the structure and the functional arrangement of a speech synthesis apparatus in Embodiment 8 are shown in the block diagrams in FIGS. 25 and 1.

The pitch waveform generation performed by the waveform generator 9 will now be explained.

A synthesis parameter that is employed for the generation of a pitch waveform is defined as $$p(m) (0 \leqq m < M).$$

With a sampling frequency of $f_s$, a sampling period is $$T_s = \frac{1}{f_s}.$$

When a pitch frequency of synthesized speech is f, a pitch period is $$T = \frac{1}{f},$$

and the pitch period point number is $$N_p(f) = f_s T = \frac{T}{T_s} = \frac{f_s}{f}.$$

The notation [x] represents an integer that is equal to or smaller than x, and the pitch period point number, which is quantized by using an integer, is expressed as $$N_p(f) = [N_p(f)].$$

When the pitch period corresponds to angle $2\pi$, an angle for each point is represented by $\theta$, $$\theta = \frac{2\pi}{N_p(f)}.$$

The value of a spectral envelope that is an integer times as large as the pitch frequency is expressed as follows:

$$e(l) = \sum_{m=0}^{M-1} p(m)\cos(ml\theta)(1 \leqq l \leqq [N_p(f)/2]).$$

A pitch waveform of half a period is $$w(k)\left(0 \leqq k \leqq \left[\frac{N_p(f)}{2}\right]\right),$$

and a power normalization coefficient that corresponds to pitch frequency f is $$C(f).$$

When a pitch frequency with which C (f)=1.0 is established is $f_0$, the following equation provides C(f):

$$C(f) = \sqrt{\frac{f}{f_0}}.$$

Sine waves that are an integer times as large as a fundamental frequency are superposed, and half-period pitch waveform w (k) ($0 \leqq k \leqq N_p$ (f)/2) can be generated by using the following expression:

$$w(k) = C(f) \sum_{l=1}^{[N_p(f)/2]} e(l)\sin(lk\theta) \quad (18)$$

-continued $$w(k) = C(f) \sum_{l=1}^{[N_p(f)/2]} \sin(lk\theta) \sum_{m=0}^{M-1} p(m)\cos(ml\theta)$$

$$w(k) = C(f) \sum_{m=0}^{M-1} p(m) \sum_{l=1}^{[N_p(f)/2]} \sin(lk\theta)\cos(ml\theta).$$

Or, the sine waves are superposed with half a phase of the pitch period being shifted, and pitch waveform w (k) ($0 \leqq k \leqq [N_p(f)/2]$) can be generated by the following expression:

$$w(k) = C(f) \sum_{l=1}^{[N_p(f)/2]} e(l)\sin(l(k\theta + \pi)) \tag{19}$$

$$w(k) = C(f) \sum_{l=1}^{[N_p(f)/2]} \sin(l(k\theta + \pi)) \sum_{m=0}^{N-1} p(m)\cos(ml\theta)$$

$$w(k) = C(f) \sum_{m=0}^{M-1} p(m) \sum_{l=1}^{[N_p(f)/2]} \sin(l(k\theta + \pi))\cos(ml\theta).$$

The pitch scale is employed as a scale for representing the tone of speech. Instead of calculating expressions (18) and (19), the speed of calculation can be increased as follows: with $N_p$ as a pitch period point number that corresponds to pitch scale s, $$\theta = \frac{2\pi}{N_p(S)}.$$

$$c_{km}(S) = \sum_{l=1}^{[N_p(S)/2]} \sin(lk\theta)\cos(ml\theta)$$

is calculated for expression (18), and $$c_{km}(S) = \sum_{l=1}^{[N_p(S)/2]} \sin(l(k\theta + \pi))\cos(ml\theta)$$

is calculated for expression (19), and these results are stored in a table. A waveform generation matrix is $$WGM(s) = (c_{km}(s)) \left( 0 \leqq k \leqq \left[ \frac{N_p(s)}{2} \right], 0 \leqq m < M \right)$$

In addition, pitch period point number $N_p$ (s) and power normalization coefficient C (s) that correspond to pitch scale s are stored in a table.

By employing, as input data, the synthesis parameter p (m) ($0 \leqq m < M$), which is output by the synthesis parameter interpolator 7, and pitch scale s, which is output by the pitch scale interpolator 8, from the table the waveform generator 9 reads pitch period point number $N_p$ (s), power normalization coefficient C (s), and waveform generation matrix WGM (s)=($c_{km}$(s)), and generates a pitch waveform of half a period by using the following equation:

$$w(k) = C(s) \sum_{m=0}^{M-1} c_{km}(s)p(m) \left( 0 \leqq k \leqq \left[ \frac{N_p(s)}{2} \right] \right).$$

The above described process will now be explained while referring to the flowchart in FIG. 7.

The procedures performed at steps S1 through S11 are the same as those performed in Embodiment 1.

At step S12, the waveform generator 9 employs synthesis parameter p [m] ($0 \leqq m < M$), which is obtained from equation (3), and pitch scale s, which is obtained from equation (4), to generate a pitch waveform. The waveform generator 9 reads, from the table, pitch period point number $N_p$ (s), power normalization coefficient C (s), and waveform generation matrix WGM (s)=($c_{km}$ (s)) ($0 \leqq k < N_p$ (s)/2, $0 \leqq m < M$), which correspond to pitch scale s, and generates a pitch waveform of half a period with the following expression:

$$w(k) = C(s) \sum_{m=0}^{M-1} c_{km}(s)p(m) \left( 0 \leqq k \leqq \left[ \frac{N_p(s)}{2} \right] \right).$$

The linking of generated pitch waveforms of half a period will be described. A speech waveform that is output as synthesized speech by the waveform generator 9 is represented as $$W(n)\ (0 \leqq n).$$

With a frame time length of the jth frame being $N_j$, the pitch waveforms of half a period are linked by the following equations:

$$\begin{cases} W(n_w + k) = w(k) & \left( i = 0, 0 \leqq k \leqq \left[ \frac{N_p(s)}{2} \right] \right) \\ W\left( \sum_{j=0}^{i-1} N_j + n_w + k \right) = w(k) & \left( i > 0, 0 \leqq k \leqq \left[ \frac{N_p(s)}{2} \right] \right) \end{cases}$$

$$\begin{cases} W(n_w + k) = -w(N_p(s) - k) & \left( i = 0, \left[ \frac{N_p(s)}{2} \right] < k < N(s) \right) \\ W\left( \sum_{j=0}^{i-1} N_j + n_w + k \right) = -w(N_p(s) - k) & \left( i > 0, \left[ \frac{N_p(s)}{2} \right] < k < N_p(s) \right) \end{cases}$$

The procedures performed at steps S13 through S17 are the same as those performed in Embodiment 1.

(Embodiment 9)

In this embodiment, an explanation will be given for an example where pitch waveforms whose pitch point number include a decimal portion are repeatedly employed by using waveform symmetry.

As they are for Embodiment 1, the structure and the functional arrangement of a speech synthesis apparatus for Embodiment 9 are shown in the block diagrams in FIGS. 25 and 1.

The processing by the waveform generator 9 for the generation of a pitch waveform will be described while referring to FIG. 24.

Suppose that a synthesis parameter that is employed for generation of a pitch waveform is $$p(m)\ (0 \leqq m < M)$$

and a sampling frequency is $f_s$. A sampling period is then $$T_s = \frac{1}{f_s}.$$

When a pitch frequency of synthesized speech is f, a pitch period is $$T = \frac{1}{f},$$

and the pitch period point number is $$N_p(f) = f_s T = \frac{T}{T_s} = \frac{f_s}{f}.$$

The notation [x] represents an integer that is equal to or smaller than x.

The decimal portion of a pitch period point number is represented by linking pitch waveforms that are shifted in phase. The number of pitch waveforms that correspond to frequency f is the number of phases $$n_p(f).$$

Figure 24:
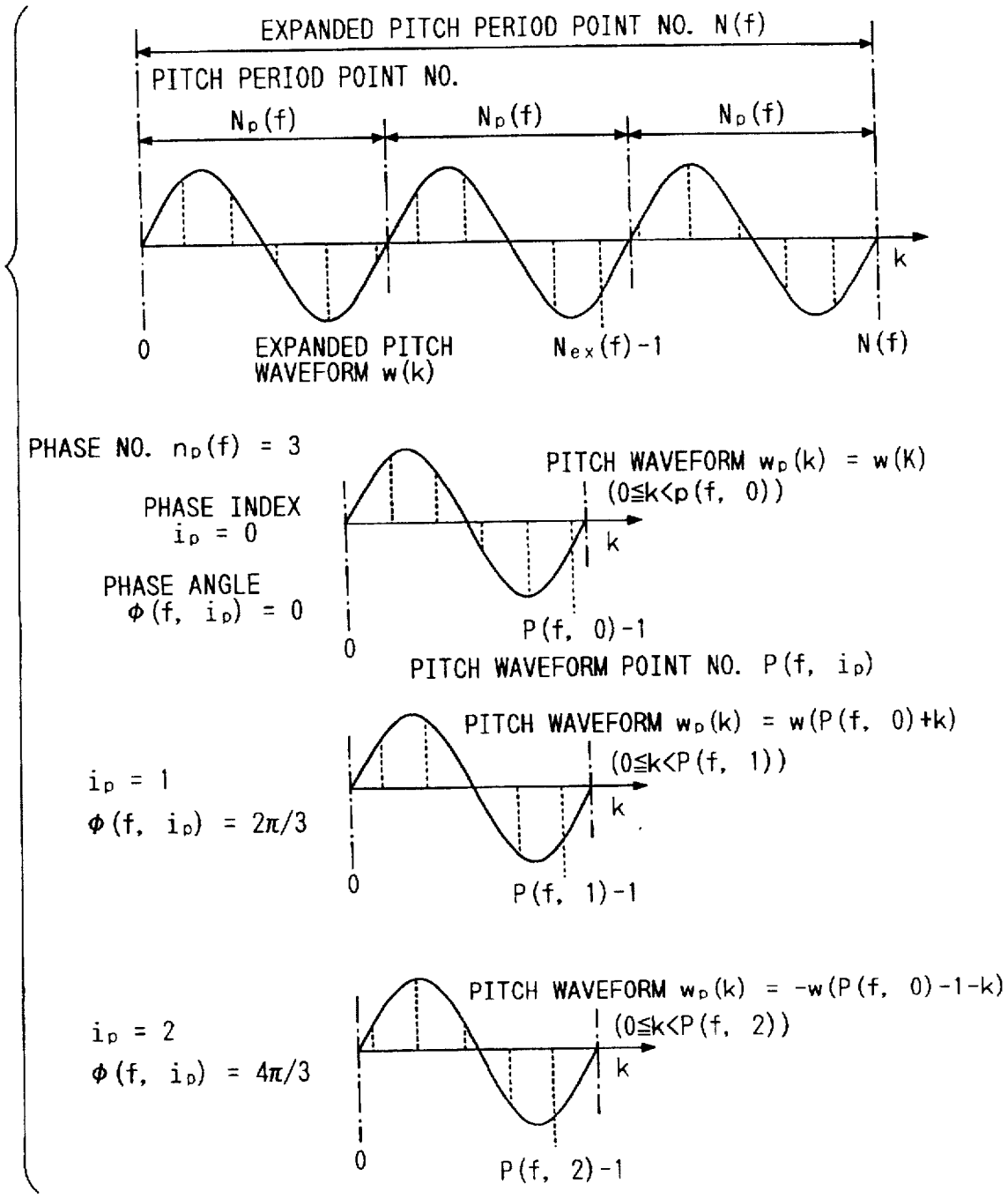
FIG. 24 is an explanatory diagram for a pitch waveform.

An example in FIG. 24 is a pitch waveform with $n_p$ (f)=3. Further, an expanded pitch period point number is expressed as $$N(f) = [n_p(f) N_p(f)] = \left[ n_p(f) \frac{f_s}{f} \right]$$

and a pitch period point number is quantized to obtain $$N_p(f) = \frac{N(f)}{n_p(f)}.$$

With $\theta_1$ as an angle for each point when the pitch period point number corresponds to angle $2\pi$, $$\theta_1 = \frac{2\pi}{N_p(f)}.$$

The value of a spectral envelope that is an integer times as large as the pitch frequency is expressed as follows:

$$e(1) = \sum_{m=0}^{M-1} p(m)\cos(ml\theta_1)(1 \leqq l \leqq [N_p(f)/2]).$$

With $\theta_2$ as an angle for each point when the expanded pitch period point number corresponds to $2\pi$, $$\theta_2 = \frac{2\pi}{N(f)}.$$

With a mod b representing the remainder obtained by the division of a by b, the expanded pitch waveform point number is defined as $$N_{ex}(f) = \left[ \frac{\left[ \frac{n_p(f)+1}{2} \right] N(f)}{n_p(f)} \right] - \left[ 1 - \frac{\left( \left[ \frac{n_p(f)+1}{2} \right] N(f) \right) \bmod n_p(f)}{n_p(f)} \right] + 1$$

the expanded pitch waveform is $$w(k)\ (0 \leqq k < N_{ex}(f)),$$

and a power normalization coefficient that corresponds to pitch frequency f is $$C(f).$$

When a pitch frequency with which C(f)=1.0 is established is $f_0$, the following equation provides C(f):

$$C(f) = \sqrt{\frac{f}{f_0}}.$$

Sine waves that are integer times of a pitch frequency are superposed, and expanded pitch waveform w (k) ($0 \leqq k < N_{ex}$ (f)) can be generated by using the following expression:

$$w(k) = C(f) \sum_{l=1}^{[N_p(f)/2]} e(l)\sin(lkn_p(f)\theta_2) \tag{20}$$

$$w(k) = C(f) \sum_{l=1}^{[N_p(f)/2]} \sin(lkn_p(f)\theta_2) \sum_{m=0}^{M-1} p(m)\cos(ml\theta_1)$$

$$w(k) = C(f) \sum_{m=0}^{M-1} p(m) \sum_{l=1}^{[n_p(f)/2]} \sin(lkn_p(f)\theta_2)\cos(ml\theta_1).$$

Or, the sine waves are superposed with half a phase of the pitch period being shifted, and expanded pitch waveform w (k) ($0 \leqq k < N_{ex}$ (f)) can be generated by using the following expression:

$$w(k) = C(f) \sum_{l=1}^{[N_p(f)/2]} e(l)\sin(l(kn_p(f)\theta_2 + \pi)) \tag{21}$$

$$w(k) = C(f) \sum_{l=1}^{[N_p(f)/2]} \sin(l(kn_p(f)\theta_2 + \pi)) \sum_{m=0}^{M-1} p(m)\cos(ml\theta_1)$$

$$w(k) = C(f) \sum_{m=0}^{M-1} p(m) \sum_{l=1}^{[N_p(f)/2]} \sin(l(kn_p(f)\theta_2 + \pi))\cos(ml\theta_1)$$

Suppose that a phase index is $$i_p (0 \leqq i_p < n_p(f)).$$

A phase angle that corresponds to pitch frequency f and phase index $i_p$ is defined as:

$$\phi(f,i_p)=\frac{2\pi}{n_p(f)}\,i_p.$$

The statement a mod b is defined as representing the remainder following the division of a by b as in $$r(f,\ i_p)=i_pN(f)\bmod n_p(f).$$

The pitch waveform point number that corresponds to phase index $i_p$ is calculated by the equation of:

$$P(f,i_p)=\left[\frac{(i_p+1)N(f)}{n_p(f)}\right]-\left[1-\frac{r(f,i_p+1)}{n_p(f)}\right]-\left[\frac{i_pN(f)}{n_p(f)}\right]+\left[1-\frac{r(f,i_p)}{n_p(f)}\right].$$

A pitch waveform that corresponds to phase index $i_p$ is defined as $$w_p(k)=\begin{cases} w(k) & (i_p=0,0\leqq k<P(f,i_p)) \\ w\left(\sum_{j=0}^{i_p-1}P(f,j)+k\right) & \left(0<i_p<\left[\frac{n_p(f)+1}{2}\right],0\leqq k<P(f,i_p)\right) \\ -w\left(\sum_{j=0}^{n_p(f)-1-i_p}P(f,j)-l-k\right) & \left(\left[\frac{n_p(f)+1}{2}\right]\leqq i_p<n_p(f),0\leqq k<P(f,i_p)\right)\end{cases}$$

Then, the phase index is updated to $$i_p=(i_p+1)\bmod n_p(f),$$

and the updated phase index is employed to calculate a phase angle to establish $$\phi_p=\phi(f,\ i_p).$$

When a pitch frequency is altered to f' for the generation of the next pitch waveform, a value of i' is calculated to satisfy $$|\phi(f,i')-\phi_p|=\min_{0\leqq i<n_p(f)}|\phi(f,i)-\phi_p|$$

in order to acquire a phase angle that is the closest to $\phi_p$, and $i_p$ is determined as $$i_p=i'.$$

The pitch scale is employed as a scale for representing the tone of speech. Instead of calculating expressions (20) and (21), the speed of calculation can be increased as follows. When $n_p$ (s) is a phase number that corresponds to pitch scale $s\in S$ (S denotes a set of pitch scales), $i_p$ ($0\leqq i_p<n_p$ (s)) is a phase index, N (s) is an expanded pitch period point number, $N_p$ (s) is a pitch period point number, and P (s, $i_p$) is a pitch waveform point number, with the following equation $$\theta_1=\frac{2\pi}{N_p(S)}$$

$$\theta_2=\frac{2\pi}{N(S)},$$

for equation (20), $$c_{km}(s,i_p)=\begin{cases}\sum_{l=1}^{[N_p(S)/2]}\sin(lkn_p(S)\theta_2)\cos(ml\theta_1) & (i_p=0) \\ \sum_{l=1}^{[N_p(S)/2]}\sin\left(l\left(\sum_{j=0}^{i_p-1}P(s,j)+k\right)n_p(S)\theta_2\right)\cos(ml\theta_1) & \left(0<i_p<\left[\frac{n_p(S)+1}{2}\right]\right)\end{cases}$$

is calculated, and for equation (21), $$c_{km}(s,i_p)=\begin{cases}\sum_{l=1}^{[N_p(S)/2]}\sin(l(kn_p(S)\theta_2+\pi)\cos(ml\theta_1) & (i_p=0) \\ \sum_{l=1}^{[N_p(S)/2]}\sin\left(l\left(\left(\sum_{j=0}^{i_p-1}P(s,j)+k\right)n_p(S)\theta_2+\pi\right)\right)\cos(ml\theta_1) & \left(0<i_p<\left[\frac{n_p(S)+1}{2}\right]\right)\end{cases}$$

is calculated, and the obtained results are stored in the table. A pitch scale generation matrix is defined as $$WGM(s, i_p)=(c_{km}(s, i_p))\ (0\leqq k<P(s, i_p),\ 0\leqq m<M).$$

A phase angle of $$\phi(s,i_p)=\frac{2\pi}{n_p(s)}\ i_p,$$

which corresponds to pitch scale s and phase index $i_p$, is stored in the table. With respect to pitch scale s and phase angle $\phi_p$ ($\in\{\phi(s, i_p)|s\in S,\ 0\leqq i<n_p(s)\}$), such a relationship that provides $i_0$ to establish $$|\phi(s,i_0)-\phi_p|=\min_{0\leqq i<n_p(s)}|\phi(s,i)-\phi_p|$$

is defined as $$i_0=I(s, \phi_p),$$

and is stored in the table. Further, phase number $n_p$ (s), pitch waveform point number P (s, $i_p$), and power normalization coefficient C (s), each of which corresponds to pitch scale s and phase index $i_p$, are stored in the table.

In the waveform generator 9, the phase index that is stored in the internal register is defined as $i_p$, the phase angle is defined as $\phi_p$, and synthesis parameter p (m) ($0\leqq m<M$), which is output by the synthesis parameter interpolator 7, and pitch scale s, which is output by the pitch scale interpolator 8, are employed as input data, so that the phase index can be determined by the following equation:

$$i_p=I(s, \phi_p).$$

The waveform generator 9 then reads from the table pitch waveform point number P (s, $i_p$) and power normalization coefficient C (s). When $$0\leqq i_p<\left[\frac{n_p(s)+1}{2}\right],$$

waveform generation matrix WGM (s, $i_p$)=($C_{km}$ (s, $i_p$)) is read from the table, and a pitch waveform is generated by using $$w_p(k)=C(s)\sum_{m=0}^{M-1}c_{km}(s,i_p)p(m)(0\leqq k<P(s,i_p)).$$

In addition, when $$\left[\frac{n_p(s)+1}{2}\right]\leqq i_p<n_p(s),$$

$$k'=P(s,n_p(s)-l-i_p)-l-k(0\leqq k<P(s,i_p))$$

is established, and waveform generation matrix WGM (s, $i_p$)=($c_{k+m}$(s, $n_p$(s)−1−$i_p$)) is read from the table. A pitch waveform is then generated by using $$w_p(k)=-C(s)\sum_{m=0}^{M-1}c_{k'm}(s,n_p(s)-1-i_p)p(m)(0\leqq k<P(s,i_p).$$

After the pitch waveform has been generated, the phase index is updated as follows:

$$i_p=(i_p+1)\bmod n_p(s),$$

and the updated phase index is employed to update the phase angle as follows:

$$\phi_p=\phi(s, i_p).$$

The above described process will now be described while referring to the flowchart in FIGS. 13A and 13B.

The procedures at steps S201 through S213 are the same as those performed in Embodiment 2.

At step S214, the waveform generator 9 employs synthesis parameter p [m] ($0\leqq m<M$), which is obtained by equation (3), and pitch scale s, which is obtained by equation (4) to generate a pitch waveform. The waveform generator 9 reads, from the table, pitch waveform point number P (s, $i_p$) and power normalization coefficient C (s). When $$0\leqq i_p<\left[\frac{n_p(s)+1}{2}\right],$$

waveform generation matrix WGM (s, $i_p$)=($c_{km}$ (s, $i_p$)) is read from the table, and a pitch waveform is generated by using $$w_p(k)=C(s)\sum_{m=0}^{M-1}c_{km}(s,i_p)p(m)(0\leqq k<P(s,i_p)).$$

In addition, when $$\left[\frac{n_p(s)+1}{2}\right]\leqq i_p<n_p(s),$$

$$k'=P(s,n_p(s)-l-i_p)-l-k(0\leqq k<P(s,i_p))$$

is established, and waveform generation matrix WGM (s, $i_p$)=($c_{k'm}$(s, $n_p$(s)−1−$i_p$)) is read from the table. A pitch waveform is then generated by using $$w_p(k)=-C(s)\sum_{m=0}^{M-1}c_{k'm}(s,n_p(s)-1-i_p)p(m)(0\leqq k<P(s,i_p).$$

A speech waveform that is output as synthesized speech by the waveform generator 9 is represented as $$W(n)\ (0\leqq n).$$

With a frame time length of the jth frame being $N_j$, the pitch waveforms are linked in the same manner as in Embodiment 1 by using the following equations:

$$W(n_w+k)=w_p(k)(i=0,0\leqq k<P(s,i_p)),$$

$$W\left(\sum_{j=0}^{l-1}N_j+n_w+k\right)=w_p(k)(i>0,0\leqq k<P(s,i_p)).$$

The procedures performed at steps S215 through S220 are the same as those performed in Embodiment 2.

What is claimed is:

1. A speech synthesis apparatus comprising:

parameter generation means for generating parameters for a speech waveform in consonance with a character series;

pitch information input means for inputting pitch information:

waveform generation matrix read means for reading a waveform generation matrix from a table which stores in advance a plurality of waveform generation matrices in accordance with the pitch information inputted by said pitch information input means; and pitch waveform output means for calculating products of the parameter generated by said parameter generation means and the waveform generation matrix read by said waveform generation matrix read means and for outputting the calculated products as pitch waveforms.

2. A speech synthesis apparatus according to claim 1, further comprising character series input means for inputting said character series.

3. A speech synthesis apparatus according to claim 1, further comprising speech output means for connecting said pitch waveforms that are generated by said pitch waveform generation means and for outputting the connected pitch waveform as speech.

4. A speech synthesis apparatus according to claim 1, wherein said pitch waveform output means calculates said products each time said pitch is changed.

5. A speech synthesis method comprising:

a parameter generation step of generating parameters for a speech waveform in consonance with a character series;

a pitch information input step for inputting pitch information;

a waveform generation matrix reading step for reading a waveform generation matrix from a table which stores in advance a plurality of waveform generation matrices in accordance with the pitch information inputted by said pitch information input step; and a pitch waveform output step of calculating products of the parameters generated by said parameter generation step and the waveform generation matrix read by said waveform generation matrix reading step to output the calculated products as pitch waveforms.

6. A speech synthesis method according to claim 5, further comprising a character series input step of inputting said character series.

7. A speech synthesis method according to claim 5, further comprising a speech output step of connecting said pitch waveforms that are generated by said pitch waveform output step and for outputting the connected pitch waveforms as speech.

8. A speech synthesis method according to claim 5, wherein product calculation at said pitch waveform output step is performed each time said pitch is changed.

9. A computer usable medium having computer readable program code means embodied therein for causing a computer to perform speech synthesis, said computer readable program code means comprising:

first computer readable program code means for causing the computer to generate parameters for a speech waveform in consonance with a character series;

second computer readable program code means for causing the inputting into the computer of pitch information;

third computer readable program code means for causing the computer to read a waveform generation matrix from a table which stores in advance a plurality of waveform generation matrices in accordance with the pitch information caused to be inputted by said second computer readable program code means; and fourth computer readable program code means for causing the computer to calculate products of the parameters caused to be generated by said first computer readable program code means and the waveform generation matrix read caused to be read by said third computer readable program code means and to output the calculated products as pitch waveforms.

10. The medium recited by claim 9, further comprising fifth computer readable program code means for causing the inputting of the character series into the computer.

11. The medium recited by claim 9, further comprising fifth computer readable program code means for causing the computer to connect the pitch waveforms that are caused to be generated by said fourth computer readable program code means and for causing the computer to output the connected pitch waveforms as speech.

12. The medium recited by claim 9, wherein said fourth computer readable program code means causes the computer to perform the product calculation each time the pitch is changed.

* * * * *

UNITED STATES PATENT AND TRADEMARK OFFICE

CERTIFICATE OF CORRECTION

PATENT NO. : 5,745,651

DATED : April 28, 1998

INVENTOR(S) : MITSURU OTSUKA, ET AL.

It is certified that error appears in the above-identified patent and that said Letters Patent is hereby corrected as shown below:

COLUMN 9,
Line 10, "$n_w=n_2+N_p(S)$," should read --$n_w = n_w+N_p(S)$,--.

COLUMN 10,
Line 38, "is" should read --is an--.
Line 39, "an" should be deleted.

COLUMN 17,
Line 32, "is" should read --is an--.
Line 33, "an" should be deleted.

COLUMN 19,
Line 21, close up right margin.
Line 22, close up left margin.

COLUMN 21,
Line 64, "itch" should read --pitch--.

COLUMN 22,
Line 21, "$[N_{p2}(f)/2]$" should read --$[N_{p1}(f)/2]$--.

UNITED STATES PATENT AND TRADEMARK OFFICE

CERTIFICATE OF CORRECTION

PATENT NO. : 5,745,651

DATED : April 28, 1998

INVENTORS : MITSURU OTSUKA, ET AL.

It is certified that error appears in the above-identified patent and that said Letters Patent is hereby corrected as shown below:

COLUMN 24,,

Line 31, "$h'(m) = \frac{1}{N}\sum_{n=o}^{N-1} p(n)(m=o)$"

should read --$h'(m) = \frac{1}{N}\sum_{n=0}^{N-1} p(n) \quad (m=o)$--.

COLUMN 25,

Line 45, "N-1" (second occurrence) should read --M-1--.

COLUMN 26,

Line 52, "$p_{1+1}$" should read --$p_{i+1}$--.

COLUMN 28,

Line 10, "is" should read --is an--.

Line 11, "an" should be deleted.

Line 28, "follows" should read --follows:--.

UNITED STATES PATENT AND TRADEMARK OFFICE

CERTIFICATE OF CORRECTION

PATENT NO. : 5,745,651

DATED : April 28, 1998

INVENTORS : MITSURU OTSUKA, ET AL.

It is certified that error appears in the above-identified patent and that said Letters Patent is hereby corrected as shown below:

COLUMN 38,
Line 46, "$[n_p(f)/2]$" should read --$[N_p(f)/2]$--.

COLUMN 41,
Line 59, "$i_p)=(c_{k+m}(s,n_p(s)-1-i_p))$" should read --$i_p)=(c_{k'm}(s,n_p(s)-1-i_p))$--.

Signed and Sealed this

Twenty-first Day of September, 1999

*Attest:*

Q. TODD DICKINSON

*Attesting Officer*

*Acting Commissioner of Patents and Trademarks*